United States Patent [19]

Stohlquist et al.

[11] 4,448,010

[45] May 15, 1984

[54] METHOD AND APPARATUS FOR MAKING BAG-TYPE PACKAGES

[75] Inventors: Roger H. Stohlquist; Jonathan G. Brown, both of Rockford; Kenneth V. Baker, Stillman Valley, all of Ill.

[73] Assignee: Anderson Bros. Mfg. Co., Rockford, Ill.

[21] Appl. No.: 330,217

[22] Filed: Dec. 14, 1981

[51] Int. Cl.[3] ..... B65B 43/04; B65B 43/16

[52] U.S. Cl. ..... 53/450; 53/455; 53/546; 53/547; 53/562; 53/563

[58] Field of Search ..... 53/455, 546, 562, 563, 53/451, 450, 469, 547, 575, 202

[56] References Cited

U.S. PATENT DOCUMENTS

| | | | |
|---|---|---|---|
| 2,555,758 | 6/1951 | Noble et al. . | |
| 2,918,769 | 6/1957 | Anderson et al. | 53/546 |
| 3,000,152 | 9/1961 | Downie . | |
| 3,045,405 | 7/1962 | Anderson et al. . | |
| 3,353,328 | 11/1967 | Wheeler et al. | 53/547 X |
| 3,382,644 | 5/1968 | Vogt | 53/562 X |
| 3,579,948 | 5/1971 | Lerner . | |
| 3,656,274 | 4/1972 | Vind | 53/562 |
| 3,855,907 | 12/1974 | Johnson et al. | 53/562 X |
| 3,952,480 | 4/1976 | Nordstrom . | |
| 4,067,173 | 1/1978 | Borrello . | |
| 4,231,560 | 11/1980 | Stohlquist et al. . | |
| 4,288,965 | 9/1981 | James . | |

*Primary Examiner*—Horace M. Culver
*Attorney, Agent, or Firm*—Vernon J. Pillote

[57] ABSTRACT

A method and apparatus for making bag-type packages from strip web material in which a lead end portion of strip web material is formed around a forward end portion of a mandrel and the sleeve is advanced with the mandrel during at least a portion of the forward stroke of the mandrel. A sleeve opening device on the lead end of the mandrel is extended through the end of the sleeve to open the sleeve and the mandrel is retracted and transversely sealed and severed at a location inwardly of its open end to form a bag. A turret is provided for gripping the open end of the bag at a bag loading station and transferring the bag with its open end up sequentially to a bag filling station and to a top closing and sealing station.

31 Claims, 34 Drawing Figures

6
6
39
74
73
76
77
77b
186
185
183a
184
182
241
63
45
48
41
178
188
187
57
58
59
47
37
46
112
35
176
G
15
15
175
17
17
131
A
111
H
8
8
184
A
A
112
35
36
36
40
188
178
187
42
47
45
48
41
186
185
183b
38
7
7

J
175
G
188
69
185
183a
241
67
58
57a
57
65
67a
54
71
77
76a
182
77b
64
75b
75
75a
59
76
42
63
46
45
47
242
74
48
41
73

10
11
12
B
91
92
93
93a
94
95
95'
96
97
98
101
101a
102
103
104
105
106
107
108
109
110

G
175
195
194
193
178
16
H
188
195
16

188
177
178
175
215
217
195
194
176
217
215
195
191
216
193
216
191
G
205a
202
192
202
H
212
205a
212

207
206
205
175
G
217
219a
215
188
206
207
205
176
178
32
207
206
205
208
209
135
134
203a
203b
215
218a
217
32

278a
278b
273
272
31
278
30
258
255
235
234
253
247
269
274
271
268
276
233
249
K
281
251
256
251
256
261a
262
261
248
266
258
252
254
232
246
263
31
30

278
278a
278b
273
253
255
247
233
272
274
258
K
271
277
268
256
281
251
261a
252
254
261
232
246
266
262
263

278
278b
K
278a
273
247
255
272
274
258
271
277
268
281
256
251
261
254
232
246
266
262
263

1:1
30:1
76a
75a
81
80
79
78
83
85
80h
84
83a
75c
78a
75d
83b
75
171
78
170a
78b
230
229a
78c
227
224a
78d
131
130
129
80a
129b
129a
80
129c
123a
124
80b
289
288a
80c
285
283a
80d
286
284a
80e
221
220a
80f
137
136a
80g
170
120
169
168
229
226
224
223
123
116
101
288
219a
219b
284
281
282
283
220
218b
218a
133
136

METHOD AND APPARATUS FOR MAKING BAG-TYPE PACKAGES

BACKGROUND OF THE INVENTION

Various different apparatus have heretofore been made for forming bag-type packages from strip web material. In some apparatus for forming bag-type packages such as disclosed in U.S. Pat. Nos. 2,918,769; 2,555,758 and 3,045,405, the package is formed around the product by depositing the product on the strip, infolding the strip to form a tube around the product, and thereafter transversely sealing the tube first at the lead and then at the trail end of the product. Such apparatus present some problems in controlling the position of the product in the strip after the product is deposited on the strip and until the strip is transversely sealed at the lead and trail sides of the product, and such apparatus are not adapted for packaging fluent materials. In the so-called vertical form-fill-seal machines, for example as disclosed in U.S. Pat. Nos. 4,067,173 and 4,288,965, the strip web material is formed into a tube as the lead end of the tube is advanced downwardly and the tube is transversely sealed at its lower lead end. Product is introduced into the upper end of the tube while it remains attached to the strip, and the tube is therafter transversely sealed and severed at the trail side of the product in the tube to separate a bag-type package from the strip. In such machines, filling of the bag occurs while the tube remains attached to the strip and this generally increases the overall cycle time since the time required to advance the sleeve and seal the sleeve is, at least in part, additive with respect to the fill time. Further, in such machines, the strip web material is formed into a downwardly extending tube by drawing the web material over a forming shoulder and this can produce stresses in the web which cause stretching and other degradation of the web material. In another type of apparatus for packaging products in strip web material, such as shown in U.S. Pat. Nos. 3,000,152; 3,579,948; and 3,952,480, the strip web material is formed into generally flattened bags that are thereafter reopened by a means such as an air blast, vacuum cups or plows external to the bag, for subsequent filling. However, problems are encountered in such machines in effecting reliable reopening of the mouth of the flattened bags.

An object of this invention is the provision of a method and apparatus for making bag-type packages from strip web material having an improved system for supporting and feeding the lead end portion of the strip and for forming a bag therein that is open at the lead end of the strip.

Another object of this invention is the provision of a method and apparatus for making bag-type packages from strip web material in which the lead end portion of the strip web material is advanced to a bag loading station and formed into a bag that is open at the lead end of the strip, and in which the open ended bag is separated from the strip at the bag loading station; transferred with its open end up to a filling station; and thereafter to a bag closing station so that filling of one bag and closing of a previously filled bag can be effected while still another bag is being formed and advanced to the bag loading station.

Various other objects of this invention are the provision of a method and apparatus for making bag-type packages from strip web material wherein the length of the bags can be readily varied; wherein the length of the bags can be correlated with printed indicia on the strips for registration of the printed indicia with the bag; in which degradation of the strip web material during formation of the bag is minimized; and which can be adapted for multi-lane operation to increase the package output of the packaging machines.

Accordingly, the present invention provides a method and apparatus for making bag-type packages from strip web material in which an elongated mandrel is moved lengthwise along a feed path in forward and return strokes, an end portion of strip web material is formed into a sleeve around the mandrel, the sleeve is advanced with its lead end forward along the feed path during at least a portion of the forward stroke of the mandrel to a forward position, the lead end of the sleeve is opened, the sleeve is transversely sealed at a location spaced inwardly of its lead end to form a bag in the sleeve that is open at the lead end of the sleeve, and the sleeve is severed at a location inwardly of the transverse seal to separate the bag from the sleeve and provide an unsealed lead end on the remaining portion of the sleeve.

Positive opening of the lead end of the sleeve is achieved by moving a forward end portion of the mandrel through the lead end of the sleeve and then retracting the forward end portion into the sleeve prior to transverse sealing of the sleeve.

Transfer of the bags from the bag loading station to the bag filling station and to the bag closing station is effected by a transfer mechanism having a plurality of gripper assemblies which are operated to grip the open end of the bag at the bag loading station; transfer the bag with its open end up to a bag filling station while holding the bag open; and thereafter transfer the bag from the bag filling station to a bag closing station.

These, together with other objects, features and advantages of this invention will become apparent from the following detailed description taken in connection with the accompanying drawings in which.

Figure 2:
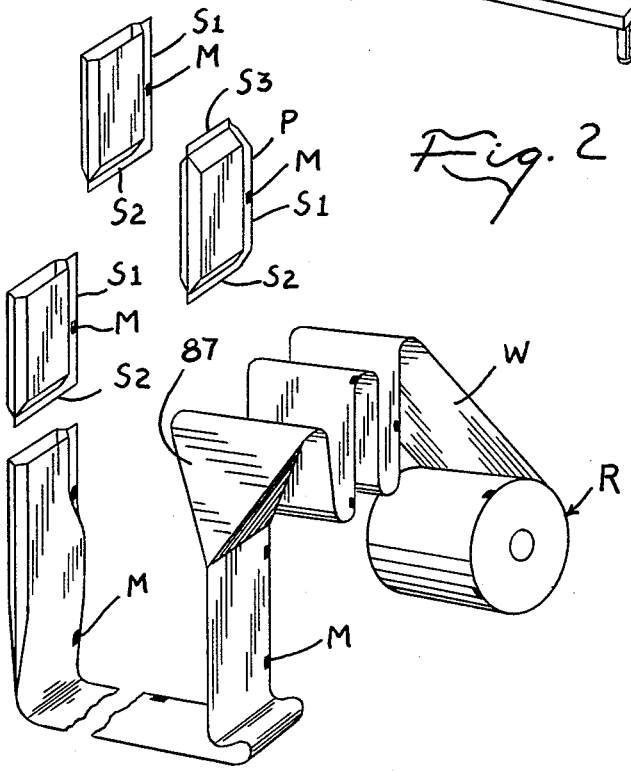
FIG. 2 is a diagrammatic view illustrating the path of the strip web material and bags as they pass through the packaging machine.

The packaging machine is arranged to make bag-type packages from strip web material W and includes an elongated mandrel A that is mounted for lengthwise movement along a feed path in forward and return strokes, a means including a side seal apparatus B for forming an end portion of the strip web material around the mandrel into a sleeve having a lead end, a feed means C for advancing the sleeve with its lead end forward along the feed path during at least a portion of the forward stroke of the mandrel to a forward position, a sleeve opening means D for opening the lead end of the sleeve, a transverse seal means E for transversely sealing the sleeve at a location spaced inwardly of its lead end to form a bag in the sleeve that is open at the lead end of the sleeve, and a cut-off means F for severing the sleeve at a location inwardly of the transverse seal to separate the bag from the sleeve and provide an unsealed lead end on the remaining portion of the sleeve. A transfer mechanism G is provided with a plurality of bag gripper assemblies H which are operative to grip an open end of the bag at a bag loading station adjacent the mandrel A; transfer the bags from the bag loading station to a filling station below a product dispenser J, and to transfer a filled bag from the filling station to a top closing and sealing station adjacent a top closing and sealing mechanism K. Bags from the top closing and sealing mechanism K are deposited on an outlet conveyor L and conveyed away from the machine. The packaging machine is arranged to form the bags from strip web material W folded lengthwise upon itself, and to reproduce packages P as shown in FIG. 2 having a side seam S1 a bottom seam S2 and a top seam S3. In the preferred embodiment illustrated, the packaging machine is a multi-lane machine with the mandrels for the several lanes disposed in close side-by-side relation.

Figure 4:
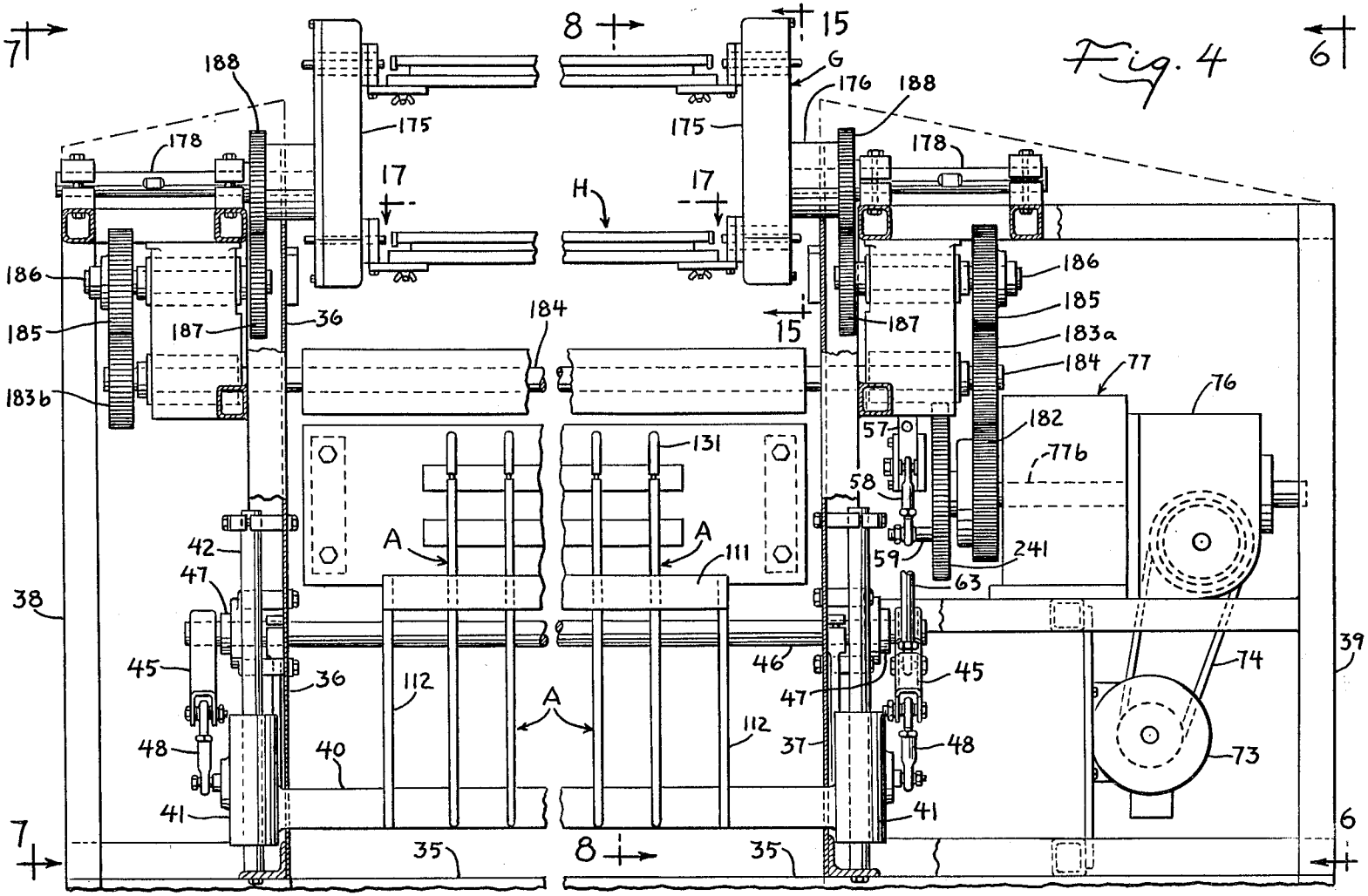
FIG. 4 is a front view taken on the plane 4—4 of FIG. 3 and with parts broken away and shown in section to illustrate the details of construction.
Figure 5:
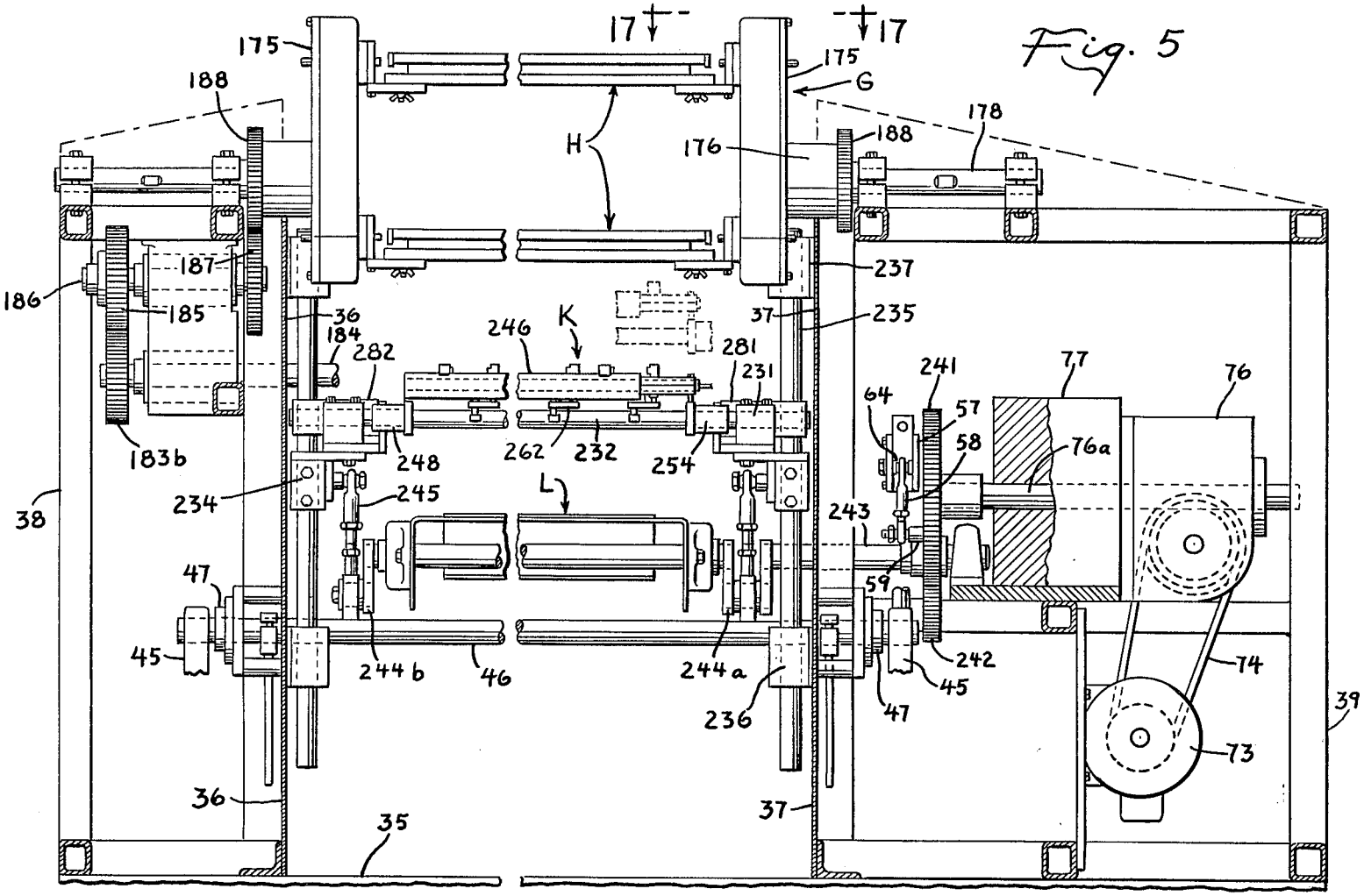
FIG. 5 is a longitudinal vertical sectional view taken on the plane 5—5 of FIG. 3.
Figure 6:
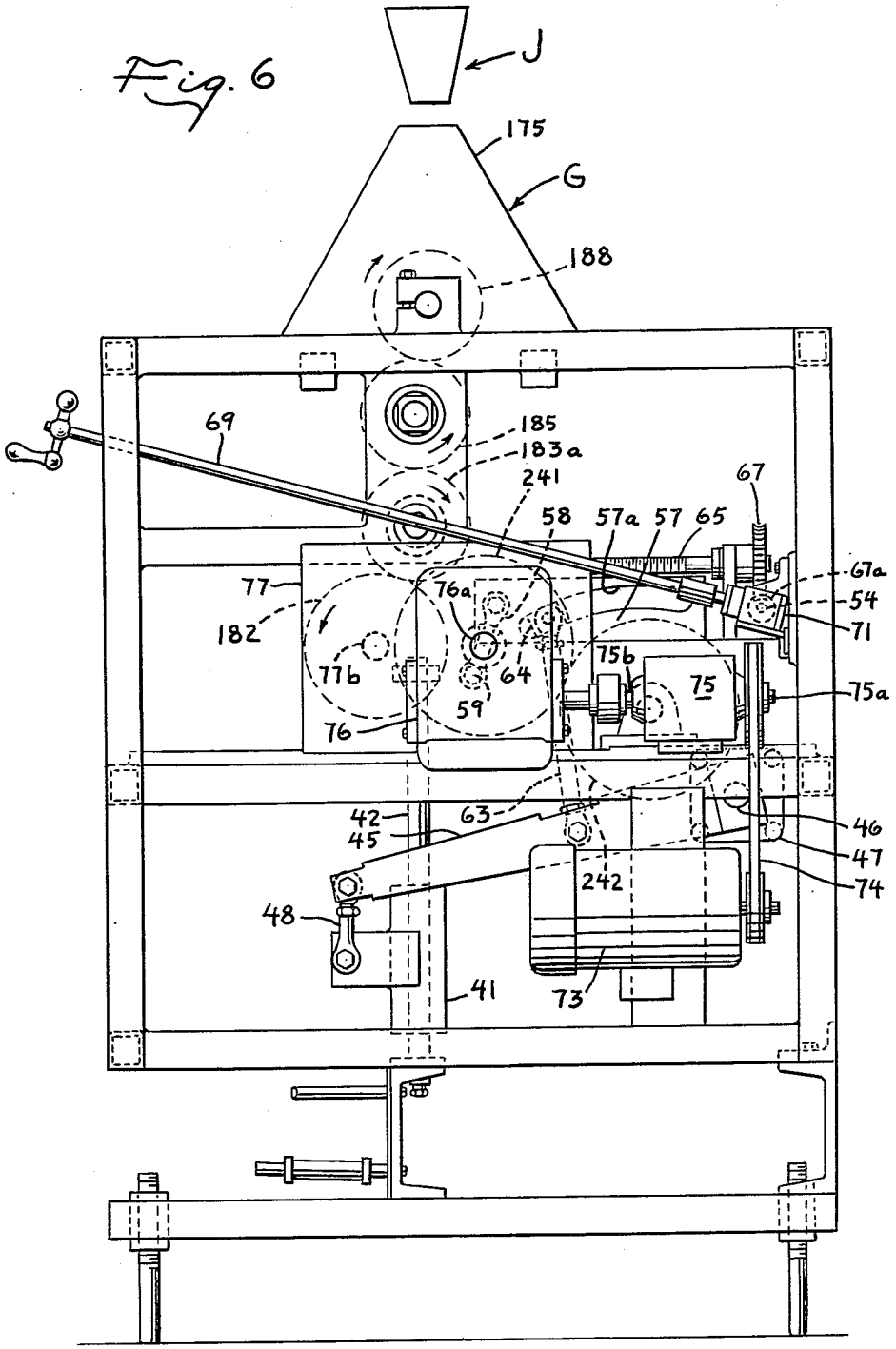
FIG. 6 is an end elevational view of one end of the packaging machine taken on the plane 6—6 of FIG. 4.
Figure 7:
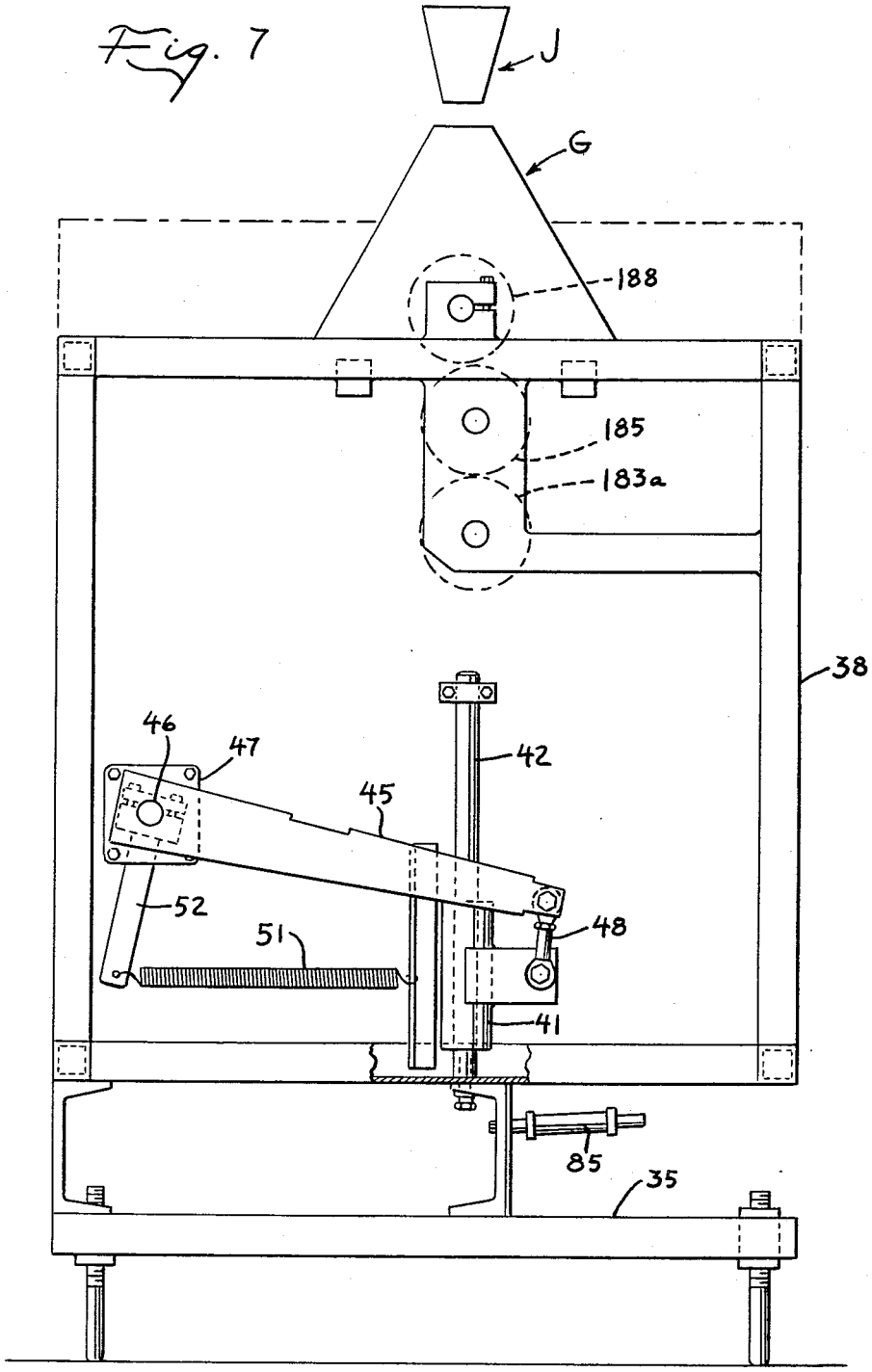
FIG. 7 is an end elevational view of the other end of the packaging machine taken on the plane 7—7 of FIG. 4.

As best shown in FIGS. 4 and 5, the support frame for the packging machine includes a base 35, intermediate upright frame sections 36 and 37 and end frame sections 38 and 39. The several mandrels A for the multi-lane machine are of like construction and are mounted on a crosshead 40 for movement in unison along paths paralleling the lengthwise axis of the mandrel. In the preferred embodiment, the mandrels are mounted for reciprocation along generally upright paths and, as best shown in FIGS. 4-6, the crosshead 40 has bushings 41 at opposite ends supported on generally upright rods 42 secured to the intermediate frame sections 36 and 37. The mandrels are raised and lowered by a pair of levers 45 rigidly secured to opposite ends of a shaft 46 that is rotatably supported in bearings 47 on the intermediate frame sections 36 and 37. The outer ends of the levers are connected by links 48 to the guides 41 for the crosshead 40. As shown in FIG. 7, a spring 51 is advantageously provided and connected to an arm 52 rigid with the shaft 46 and arranged to at least partially counterbalance the weight of the crosshead and mandrels.

The levers 45 are driven from a drive that is adjustable to vary the stroke of the mandrels and the length of the packages produced by the machine. As best shown in FIGS. 3-6, a shaft 54 is rotatably supported in bearings 55 and 56 on the stationary frame structure and an arm 57 is supported on the shaft 54 for swinging movement relative thereto in an upright plane. The free end of the arm 57 is connected by a link 58 to a crank 59. One of the levers 45 for raising and lowering the mandrel is connected by a link 63 to a follower 64 that is movable along a slot 57*a* in the arm 57 in a direction toward and away from the shaft 54. In order to enable adjustment of the follower 64 along the arm 57 while the arm is in motion, a screw shaft 65 is mounted on the arm for swinging movement therewith about the axis of shaft 54 and operatively connected to the follower 64 to move the follower along the slot 57*a* in response to rotation of the screw shaft. A worm wheel 67 on the screw shaft 65 meshes with a worm gear 67*a* (See FIGS. 3 and 6) on the shaft 54 and a manually operable shaft 69 is connected through a right angle gear drive 71 to the shaft 54 to rotate the shaft from a location at the front of the machine.

Referring now to FIGS. 3–6 and 33, the crank 59 is intermittently driven from a motor 73 through belt drive 74, clutch brake unit 75, speed reducer drive 76 and index drive unit 77. The clutch-brake unit 75 is of a known type and, as diagrammatically shown in FIG. 33, has a clutch 75c which can be selectively energized to drivingly connect a continuously rotating clutch input shaft 75a in a clutch output 75b in the clutch-brake unit, and a brake 75d which is energized when the clutch is de-energized, to stop the clutch output shaft 75b. The speed reducer drive unit has a preselected speed reduction, for example 20:1 and the clutch 75c is periodically energized to drive the clutch output shaft 75b through a number of revolutions corresponding to the speed reduction in the speed reducer drive 76 to cause the output shaft 76a of the speed reducer drive to rotate through one revolution and then dwell for a selected time interval. The speed reducer output shaft 76a extends through the index drive unit 77 and is connected to the crank 59 to rotate the crank with the shaft 76a. The clutch-brake unit is energized under the control of a cycle control apparatus which is operative to initiate energization of the clutch at preselected time intervals corresponding to the overall packaging machine cycle time, and to de-energize the clutch and energize the brake after the shaft 76a completes one revolution. For example, the cycle control apparatus may, as diagrammarically shown in FIG. 33, include a first cam shaft 78 that is drivingly connected through a speed reducer 79 to continuously rotating input shaft 76a of the clutch-brake unit 75 and a second cam shaft 80 that is drivingly connected through a one-to-one ratio drive 81 to the intermittently rotated output shaft 76a of the speed reducer 76. Thus, cam shaft 80 is intermittently rotated through one revolution when the crank 59 is rotated through one revolution.

Figure 33:
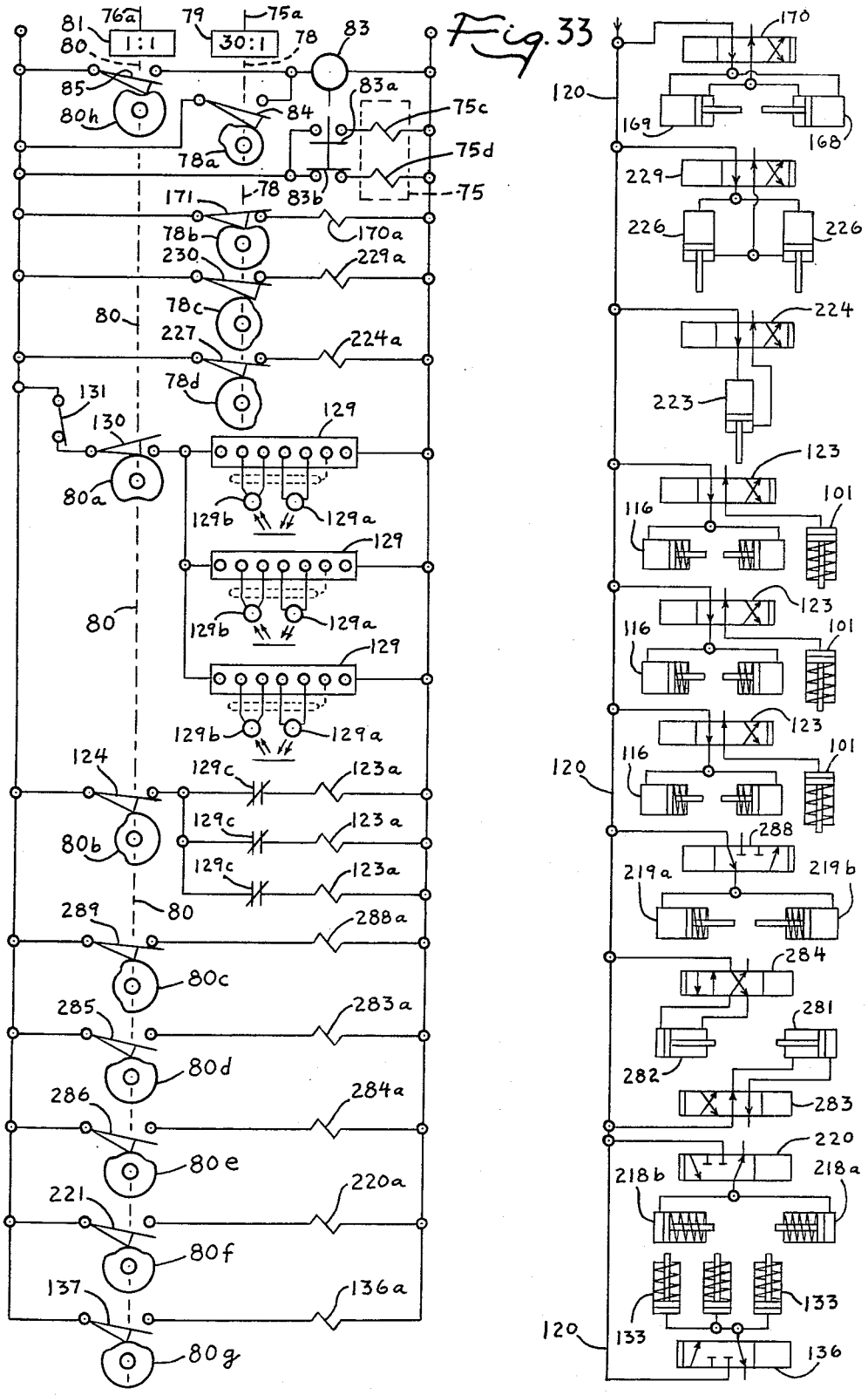
FIG. 33 is a schemmatic diagram of the electrical and pneumatic controls for the packaging machine.

The speed reducer 79 is arranged to drive cam shaft 78 in continuous fashion at a speed such that shaft 78 completes one revolution in a time corresponding to the overall packaging machine cycle time. For example, if the clutch input shaft 75a is driven at 1200 RPM, a speed reduction of 30:1 in speed reducer 79 will cause cam shaft 78 to complete one revolution in 1.5 seconds, as indicated by the lower scale in FIG. 34. With a 20:1 speed reduction in the speed reducer drive 76. The clutch-brake unit is energized for 20 revolutions of the clutch input shaft and will drive the speed reducer output shaft through one revolution in 1.0 seconds. As shown in FIG. 33, energization of clutch 75c and brake 75b is controlled by relay switch 83a and 83b of relay 83. Relay 83 is energized under the control of parallel connected switches 84 and 85 respectively operated by cams 78a and 80h on cam shafts 78 and 80. Cam 78a is arranged to initiate a cycle by closing switch 84 to energize the clutch 75c and deenergize the brake 75d of the clutch-brake unit and start rotation of the speed reducer output shaft 76a. Cam 80h on the cam shaft 80 then operates to close switch 85 until shaft 76a completes one revolution. Cam 78a opens switch 84 before the speed reducer output shaft 76a completes one revolution so that the shaft 76a is stopped when the cam 80h opens switch 85 and shaft 76a then dwells until the cam 78a again closes switch 84. As will be readily apparent to those skilled in the art, other cycle control systems could be provided and the cycle control system could be arranged so that cycling of the packging machine is under the control of an apparatus that produces and dispenses product to synchronize packging of products with the production of the products.

Figure 34:
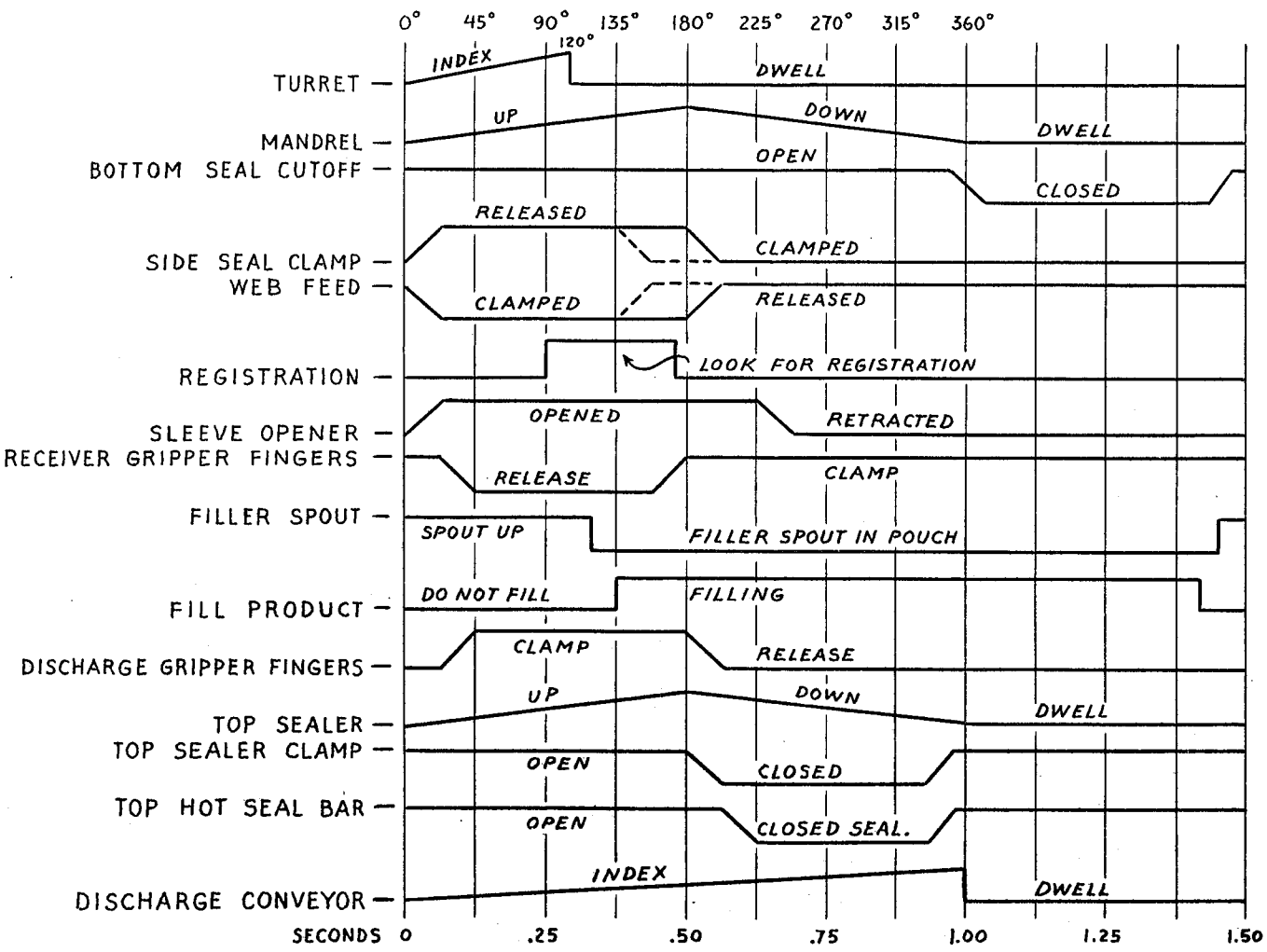
FIG. 34 is a timing diagram for the packaging machine.

In the timing diagram of FIG. 34, the overall cycle time in seconds is indicated in the scale along the bottom of the diagram and the position of the crank 59 in degrees is indicated in the scale along the top of the diagram. In the example described above, the crank 59 completes its revolution through 360° in 1.0 seconds and substantially before the end of the overall cycle time of 1.5 seconds. It is deemed apparent however, that the overall cycle time can be varied by changing the speed of the input shaft 75a of the clutch-brake unit, as by using a variable speed belt drive 74.

Figure 1:
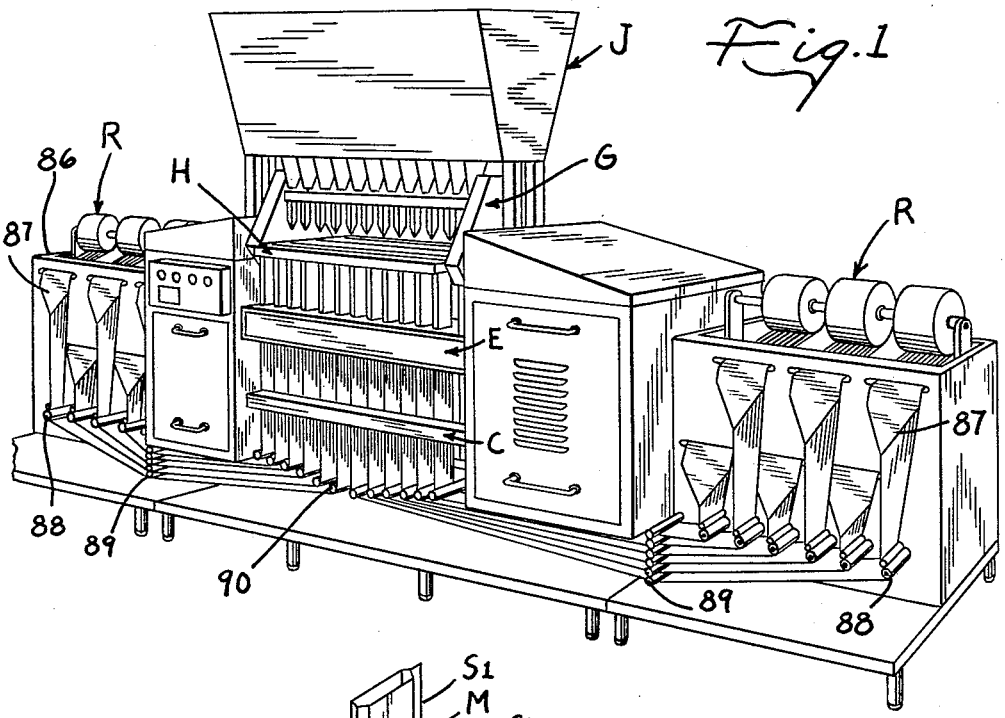
FIG. 1 is a perspective view of a packaging machine for making bag-type packages in accordance with the present invention.

The web material W for forming the packages is preferably of the heat sealable type and may, for example, be heat sealable plastic material or paper coated with a heat sealable coating. As shown in FIG. 1, a plurality of rolls R of web material are supported on web payoff stand 86 conveniently located at one and preferably both ends of the packaging machine. In the embodiment illustrated, the packaging machine is arranged to form packages from strip web material that is folded longitudinally upon itself and the web payoff stands each include folding plows 87 for folding the strip web material upon itself and payoff rollers 88 which are operative to assist in feeding and guiding the folded web from the supply rolls R to exiting guide rollers 89. The web payoff stand may, for example, be of the type disclosed in U.S. Pat. No. 4,231,560 to which reference is made for a more complete disclosure. As is more fully disclosed in that patent, the drive to the payoff rollers 88 is controlled in response to the tension on the webs as it exits from the payoff rollers, and the payoff rollers are operative to feed the webs to the packaging machine at a rate to maintain a generally low uniform tension on the webs supplied to the packaging machine.

The longitudinally folded strips of web material are guided over idler rolls 90 disposed below and in vertical alignment with a respective one of the mandrels A, and end portion of the folded strip of web material is opened sufficient to receive the mandrel between opposite side walls of the folded strip.

Figures 9, 10, 11, 12:
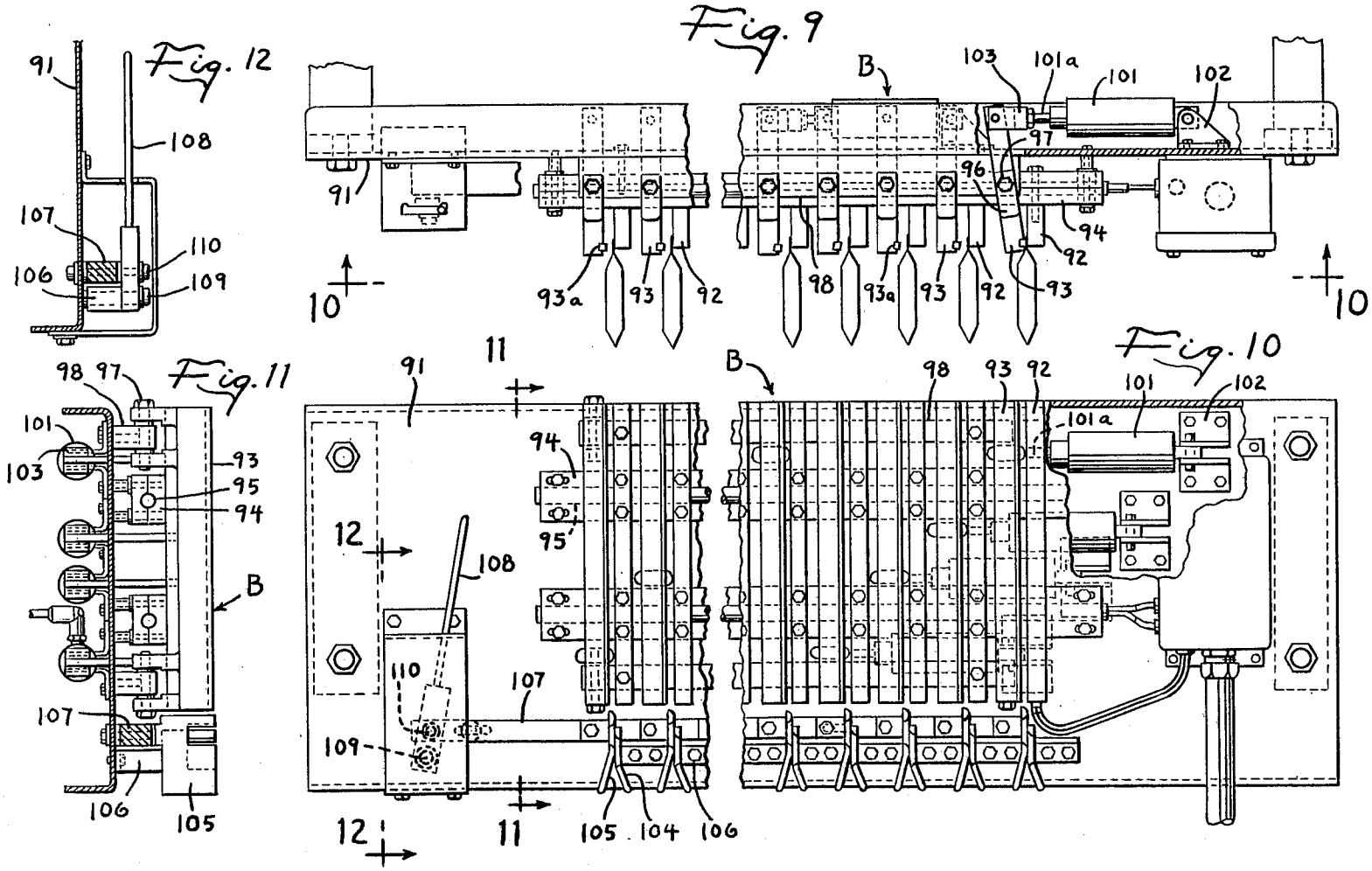
FIG. 9 is a fragmentary horizontal sectional view taken on the plane 9—9 of FIG. 8 and showing the longitudinal sealing mechanism on a larger scale than FIG. 8.
FIG. 10 is a front view of the longitudinal sealing mechanism taken on the plane 10—10 of FIG. 9.
FIG. 11 is a transverse sectional view through the longitudinal sealing mechanism taken on the plane 11—11 of FIG. 10.
FIG. 12 is a fragmentary transverse sectional view taken on the plane 12—12 of FIG. 10.

The longitudinal seaming mechanism B and the feed mechanism C are operated in timed relation with each other and with the reciprocation of the mandrel to longitudinally seam the folded web to form a sleeve, and to feed the sleeve upwardly. The longitudinal seaming mechanism B is mounted on a support member 91 and, as best shown in FIGS. 9–12, the longitudinal seam mechanism includes a plurality of stationary sealing jaw members 92, one for each lane of the packaging machine, and a corresponding plurality of movable sealing jaw members 93, each adapted to cooperate with a respective one of the stationary sealing jaw members to clamp and seal edge portions of the strip web material therebetween to form a sleeve. The stationary sealing jaw members 92 are heated to effect heat sealing of the strip web material and are mounted on bars 94 heated by electrical heating elements 95. The movable sealing jaw members 93 are supported on levers 96 that are pivotally mounted intermediate their ends as by pivot pins 97 on support rails 98 attached to the support 91. The reasons which will become apparent hereinafter, the several movable sealing jaw members have individual actuators that can be selectively actuated to move the associated jaw member into and out of clamped position. As best shown in FIGS. 9–11, the actuators comprise fluid cylinders 101 mounted by brackets 102 on the support member 91 and having a piston 101*a* connected by a clevis 103 to a respective one of the levers 96. The movable jaw members 93 generally parallel the stationary jaw member 92 and the movable jaw members preferably have a resilient jaw face 93*a* formed of a strip of elastomeric material, to resiliently clamp the overlapping longitudinal edge portions of the longitudinally folded strip of web material to the respective stationary jaw member. A plurality of pairs of relatively converging fin guides 104 and 105 are mounted on the support 91 at a location below the relatively movable clamp jaws, to guide the longitudingal edges of the folded strip of web material together and into the space between the clamp jaws, as the folded strip of web material is advanced. One fin guide 104 of each pair is fixedly mounted on a support rail 106 attached to the support 91, and the other guide 105 of each pair is attached to a support rail 107 that is supported for lengthwise movement on the support 91, to enable movement of the guides 105 away from the guides 104 and facilitate threading of the web material through the longitudinal seaming mechanism. A means such as a lever 108 is mounted as by a pivot 109 on the support 91 and connected as by a pin 110 to the rail 107 to facilitate movement of the guides 105 into and out of their guide position.

Figure 13:
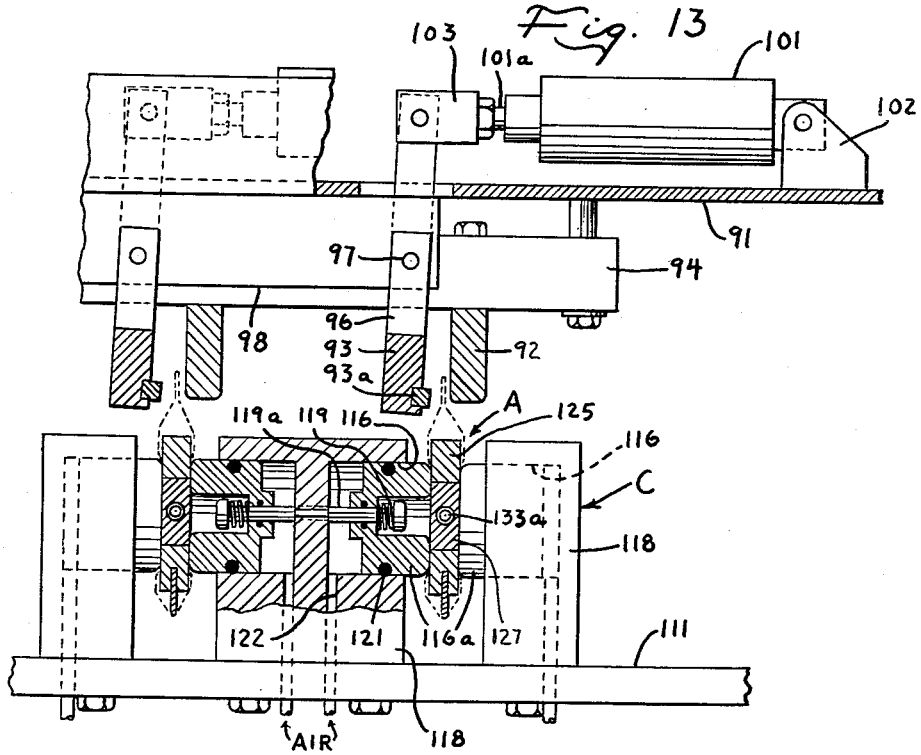
FIGS. 13 and 14 are fragmentary horizontal sectional views taken on the plane 13—13 of FIG. 8 and illustrating the longitudinal sealing and feed mechanism on a larger scale than FIG. 8 and in different moved positions.
Figure 14:
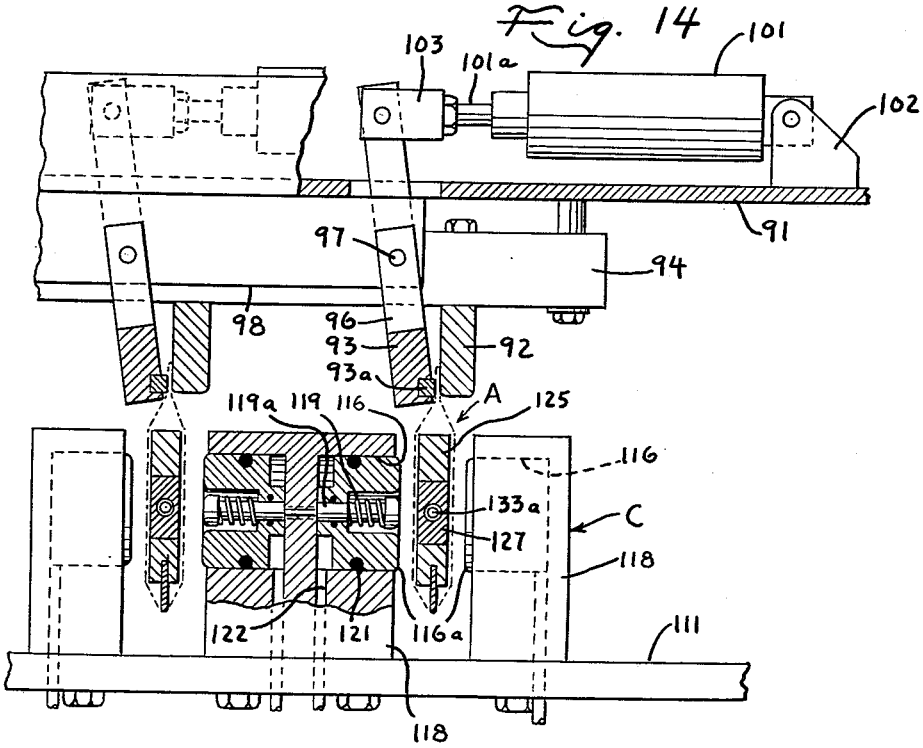

The feed mechanism C includes means individual to each lane for gripping the sleeve of wrapping material and feeding the sleeve upwardly along the path of movement of the respective mandrel during at least a portion of the upward movement of the mandrel. In the preferred embodiment illustrated, the feed mechanism C includes means for clamping the sleeves to the associated mandrel during at least a portion of the upward stroke of the mandrel, and for releasing the sleeve during the return stroke of the mandrel. The feed mechanisms for the several lanes of the wrapping machine are conveniently mounted on a crosshead 111 supported at its ends by brackets 112 and return legs 113 on the guides 41 for vertical movement in unison with the mandrels. As best shown in FIGS. 13 and 14, the feed mechanism for each lane of the wrapping machine includes a pair of opposed feed pistons 116*a* disposed at opposite sides of the respective mandrel at a location intermediate its ends, and slidably disposed in cylinders 116 provided in cylinder heads 118 attached to the crosshead 111. The pistons are yieldably urged to a retracted position away from the respective mandrel as by springs 119 interposed between the pistons and the heads on the guide pins 119*a* and the pistons are sealed to the respective cylinder by O-rings 121. The pistons can be selectively extended to their clamp position by the introduction of fluid pressure through passages 122.

As schematically shown in FIG. 33 a control valve 123 is provided for each lane of the wrapping machine, and each control valve is arranged to reversibly supply fluid pressure from a supply line 120 to the cylinders 101 and 116 associated with a respective one of the lanes. In order to simplify the drawings, the controls for only three lanes are shown in FIG. 33, it being apparent that controls for additional lanes could be provided in a similar manner. The control valve 123 for each lane is connected so that, when in a first valve position shown in FIG. 33, it applies fluid pressure to a pair of cylinders 116 associated with that lane to move the opposed feed pistons 116*a* to their feed position while exhausting fluid pressure from the cylinder 101 to release the clamp jaw member associated with that lane. When the valve 123 is moved to the second position it reverses the application of fluid pressure to the associated cylinders 101 and 116 and moves the feed pistons 116*a* to their release position while moving the clamp jaw members to their clamp position. The valves 123 are normally biased to their second position and are selectively moved to their first position by an electro-responsive valve actuator 123*a* in timed relation with the reciprocation of the mandrels A and as shown in FIG. 33, the several valve actuators are energized under the control of a switch 124 operated by a cam 80*b* on the cam shaft 80. The cam 80*b* is arranged to energize the several valve actuators 123*a* and move the associated valves to their first position during at least a major portion of the up-stroke of the mandrels to feed the web material upwardly with the mandrels. The crank drive causes the mandrels to progressively accelerate as they move away from one end of their stroke and to progressively decelerate as they approach the other end of their stroke, and the valves 123 are preferably operated to cause the feed pistons 116*a* to feed the web during at least the major portion of the up-stroke of the mandrels, with changes of the average bag length effected by adjusting the stroke of the mandrels as previously described. However, variation in web feed can also be effected by changing the portion of the up-stroke of the mandrels during which the feed pistons clamp the webs to the mandrels, and provision is advantageously made for correlating the feeding of the individual strips of web material with printed indicia M on the strips to obtain a preselected registration of the printed indicia with the bags.

Figure 23:
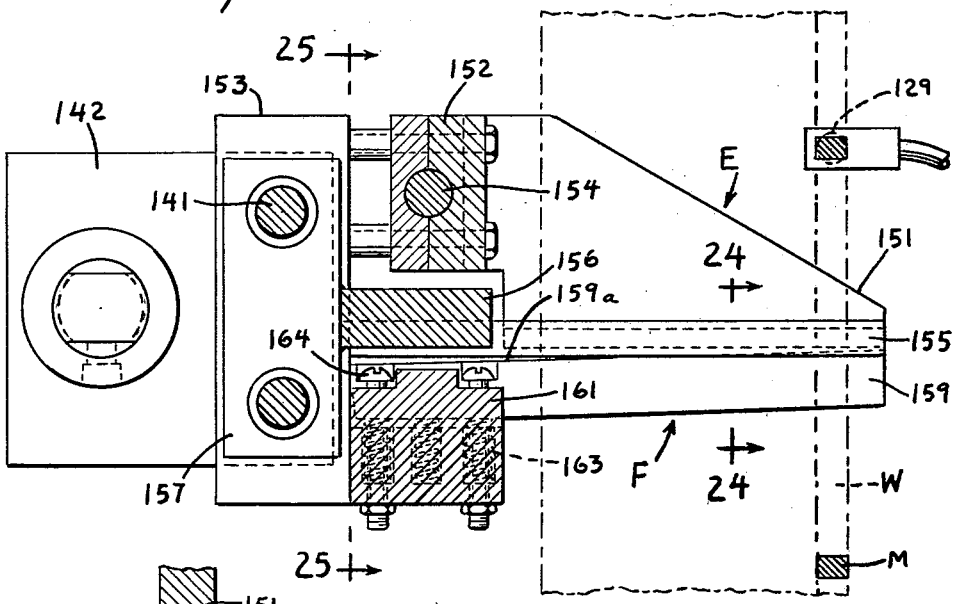
FIG. 23 is a transverse sectional view through the bottom seal and cut-off assembly taken on the plane 23—23 of FIG. 22.

As diagrammatically shown in FIG. 33, a photoelectric detector apparatus 129 is provided for each lane of the wrapping machine and each includes a light transmitter 129*a* and a photo-cell 129*b* mounted as shown in FIG. 23 to sense registration indicia on the webs as the strips are advanced to their raised position. The photoelectric detectors 129 for each lane are arranged to operate a respective relay switch 129*c* connected in series with the electroresponsive valve actuator 123*a* associated with the lane and, in the embodiment disclosed, the photoelectric detectors are of a type which are energized to open their normally closed relay contacts 129*c* when the photo-cells 129*b* detect a dark registration indicia. Opening of the relay contacts 129*c* de-energizes the associated valve actuator 123*a* so that the respective valve 123 moves to its second position and interrupts feeding of the web. The photoelectric detectors 129 are activated only during a portion of the upward stroke of the web and activation of the detectors is controlled by a switch 130 operated by a cam 80*a* on the cam shaft 80. A manually operable switch 131 can be provided in series with cam switch 130 to enable operation of the machine without control by the photoelectric web registration apparatus when the switch 131 is opened.

Figure 8:
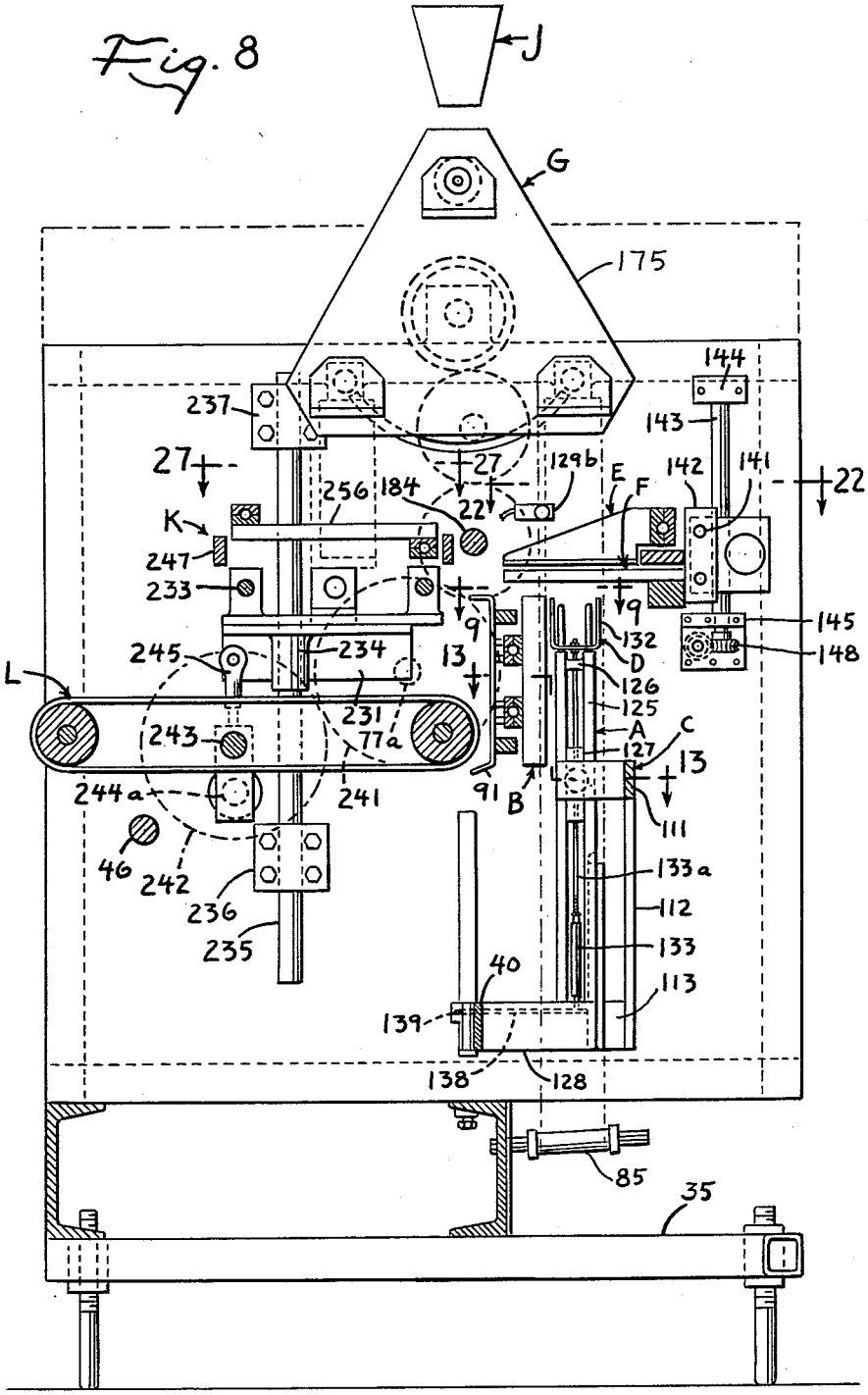
FIG. 8 is a transverse vertical sectional view through the packaging machine taken on the plane 8—8 of FIG. 4.
Figure 32:
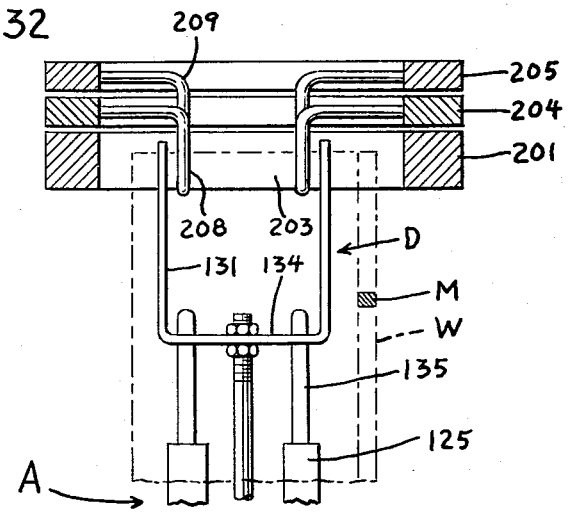
FIG. 32 is a fragmentary vertical sectional view taken on the plane 32—32 of FIG. 17.

The mandrel A supports and guides the sleeve as it is advanced upwardly and, in accordance with the present invention, provision is made for extending a lead end portion of the mandrel at least to and preferably through the lead end of the sleeve to open the sleeve. The mandrel A has a cross-section somewhat smaller than the cross-section of the sleeve and in the embodiment shown, comprises a pair of upright mandrel bars 125 which are interconnected in spaced relation to each other by cross pieces 126 and 127, and which mandrel bars are mounted at their lower ends by arms 128 on the crosshead 40. As best shown in FIGS. 13 and 14, cross piece 127 preferably is disposed flush with the outer faces of the mandrel bars 125 and is located adjacent the web feed pistons 116*a* to provide a generally flat surface on opposite sides of the mandrel to cooperate with the opposed feed pistons 116*a*. The sleeve opening device D is provided at the upper end of the mandrel and is arranged to open the lead end of the sleeve when the sleeve opening device is moved to the lead end of the sleeve. The sleeve opening device comprises a pair of blades 132 that are spaced apart in a direction of the major transverse dimension of the mandrel. As shown in FIG. 4, the blades 131 preferably have a width approximating the width of the minor transverse dimension of the mandrel and are rounded at their upper ends to facilitate movement through the lead end of the sleeve. The sleeve opening device D is mounted for movement with the mandrel and, advantageously, is also mounted for extension and retraction relative to the mandrel. As shown in FIG. 8, extension and retraction of each sleeve opening device D relative to the associated mandrel is effected by a fluid actuator 133 mounted on the arm 128 between the mandrel bars 125 and having an actuating rod 133*a* extending upwardly between the mandrel bars and connected to the sleeve opening device D. As best shown in FIG. 32, the blades 131 of the sleeve opening device are interconnected at their lower ends by a cross piece 134 that is connected to the upper end of the actuator rod 133*a* and guide pins 135 are provided on the upper ends of the mandrel bars 125 and extend through openings in the cross piece to guide the same during extension and retraction relative to the mandrel. The fluid actuators 133 are preferably of the type having an internal return spring (not shown) to normally return the sleeve opening device to its retracted position relative to the mandrel, and passages 138 are provided in the arms 128 to communicate the lower ends of the fluid actuators 133 to a fluid pressure supply passage 139 on the crosshead 40. As schematically shown in FIG. 33, a valve 136 is provided to control the application of fluid pressure to the several actuators 133 and has an electroresponsive valve actuator 136*a* energized under the control of a switch 137 operated by a cam 80*g* on cam shaft 80 to effect extension and retraction of the sleeve opening devices relative to the mandrels, in timed relation with the reciprocation of the mandrels. Preferably, the sleeve opening devices are extended relative to the mandrels to effect opening of the sleeves before the sleeves reach their fully raised position, and to hold the sleeves in an open condition while they are in their raised position, as graphically shown in FIG. 34 by the line designated "Sleeve Opener".

The bag bottom seal mechanism E and cut-off mechanism F are operated in timed relation with the reciprocation of the mandrel and arranged to seal the sleeve at a location spaced below its upper end a distance corresponding to the desired bag length, and to sever the bag at a location below the transverse seal. The lower transverse seal and cut-off mechanism is advantageously mounted for vertical adjustment. As best shown in FIGS. 8 and 22–26, the transverse sealing and cut-off mechanism E, F is mounted on horizontally disposed guide bars 141 that are supported at their ends on heads 142. The heads 142 are threadedly mounted on upright screws 143 that are rotatably supported at their upper and lower ends on bearing brackets 144 and 145 on the intermediate frame sections 36 and 37. The screws 143 can be rotated as by a worm and worm wheel drive indicated at 148 in FIG. 8, to vertically adjust the transverse sealing and cut-off mechanism and thereby adjust the length of the bags to be formed.

Figure 22:
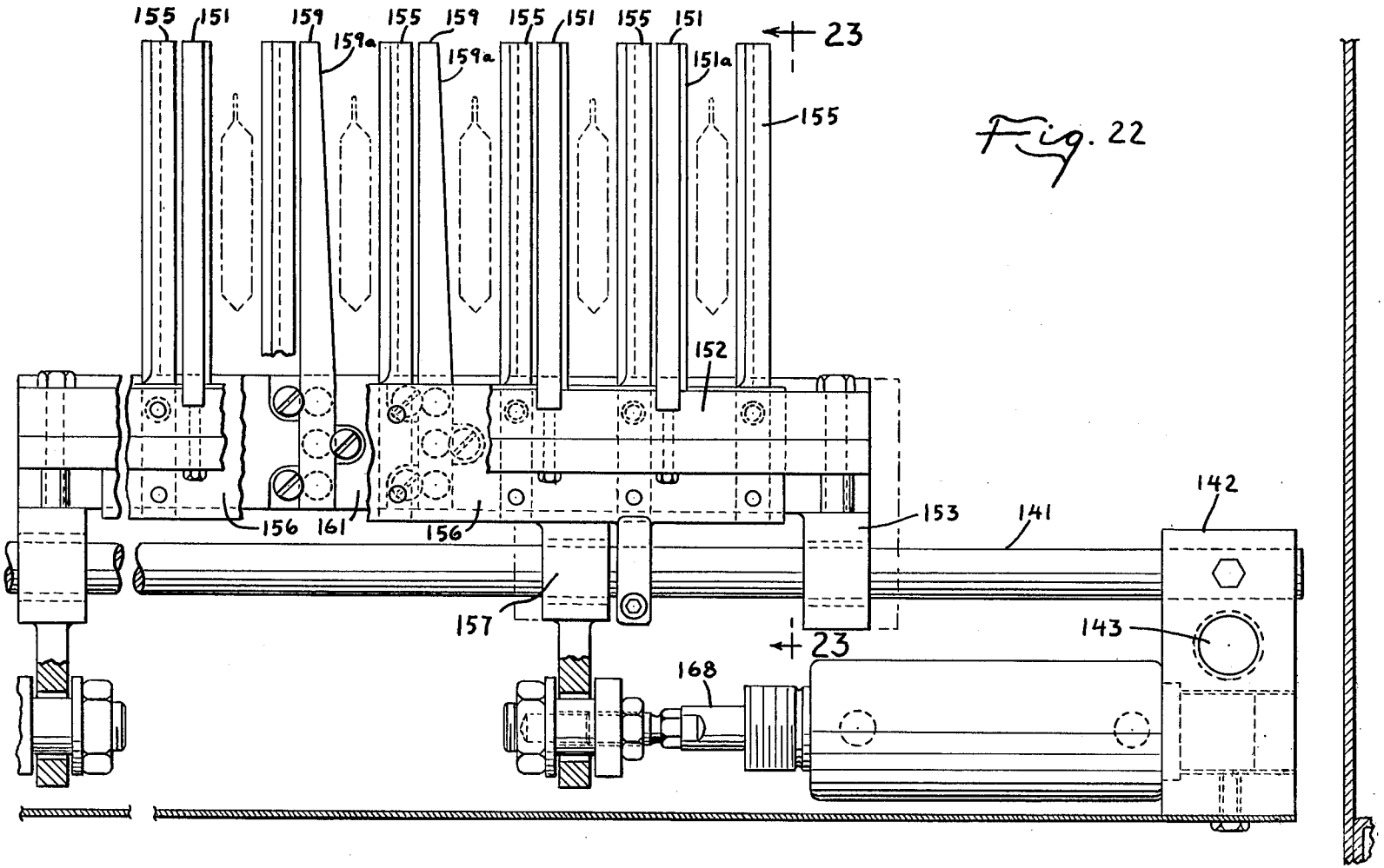
FIG. 22 is a fragmentary horizontal sectional view taken on the plane 22—22 of FIG. 8 and illustrating the bottom seal and cut-off mechanism on a larger scale than FIG. 8.
Figure 24:
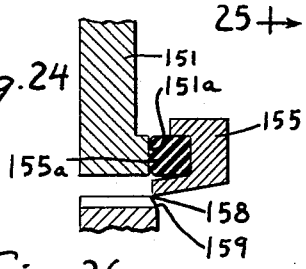
FIG. 24 is a fragmentary transverse sectional view through the bottom seal and cut-off jaw taken on the plane 24—24 of FIG. 23.
Figure 26:
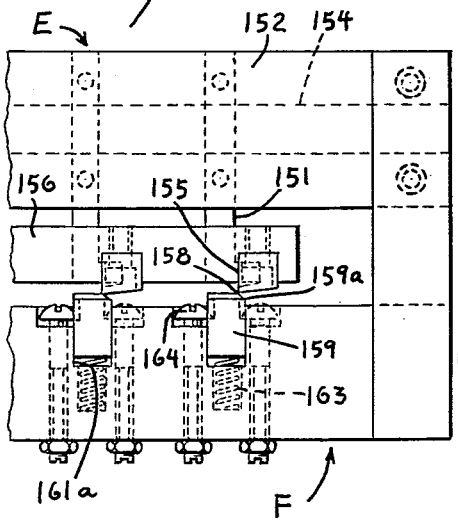
FIGS. 25 and 26 are fragmentary views of the bottom seal and cut-off mechanism taken on the plane 25—25 of FIG. 23 and illustrating the jaws in different move positions.
Figure 25:
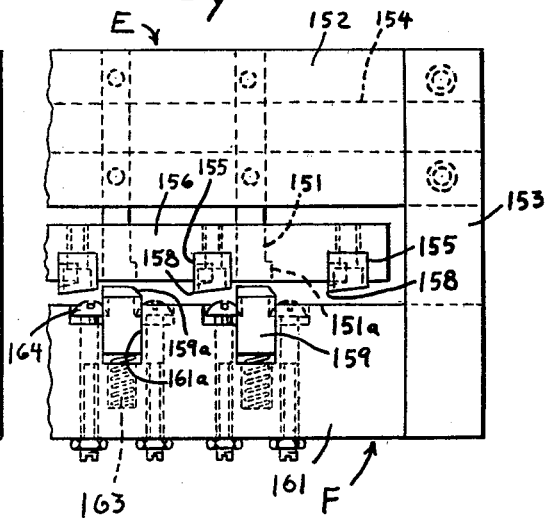

The transverse seal mechanism E includes a plurality of pairs of seal jaws 151 and 155, with one pair associated with each lane of the multi-lane packaging machine. The seal jaws are disposed at relatively opposite sides of the path of travel of the sleeve as it is advanced upwardly, and are relatively movable toward and away from each other to clamp and seal the opposite sides of the sleeve together. The seal jaws 151 are mounted at spaced locations along a bar 152 that is supported by followers 153 for movement along the guide bars 141. The bar 152 is heated, as by an electrical heater 154, and the jaws 151 are formed of a heat conducting material adapted to be heated by the heaters 154 to a temperature such that their faces 151*a* are operative to heat seal the overlapping plys of the sleeve together. The jaws 155 are similarly mounted at spaced locations along a bar 156 that is supported as by followers 157 on the guide bars 141, for movement therealong. As best shown in FIG. 24, the jaws 155 are preferably formed with a resilient jaw face 155*a* which is adapted to resiliently clamp the overlapping plys of the sleeve to the jaw face 151*a* on the sealing jaws 151. The cut-off mechanism F is arranged to sever the sleeve at a location below the transverse seal formed by the jaws 151 and 155. The cut-off mechanism includes a pair of cut-off jaws 158 and 159 associated with each lane of the multi-lane packaging machine and normally disposed at relatively opposite sides of the path of travel of the sleeve. As best shown in FIG. 24, one of the cut-off jaws 158 is conveniently formed integrally with the seal jaw 155 and is disposed at a level below the jaw face 155*a*. The other cut-off jaw 159 of each pair of cut-off jaws are mounted at spaced locations along a bar 161 which is supported adjacent its ends on the followers 153. Thus, the cut-off jaws 158 move in unison with the clamp jaws 155 and the cut-off jaws 159 move in unison with the clamp jaws 151. As shown in FIG. 22, the cutting edge 159*a* of the jaw 159 diverges in a direction away from the bar 161 relative to the cutter jaw 158 and, as shown in FIG. 23, the cutting edge 159*a* of the jaw 159 is normally inclined upwardly in a direction away from the bar 161, relative to the cutting edge of jaw 158. Jaw 159 is guidably supported in slots 161*a* in the bar 161 and the jaw 159 is yieldably biased upwardly by springs 163 against stops formed by the heads of bolts 164. Thus, the cut-off jaws 158 and 159 close with somewhat of a scissors action and the lower cut-off jaw 159 is yieldably mounted to maintain contact with the cutting edges as the cut-off jaws close.

As previously described, the seal jaws 151 and 155 are disposed at relatively opposite sides of the path of travel of a respective one of the sleeves of wrapping material as it is advanced upwardly and the cut-off jaws 158, 159 are similarly disposed at relatively opposite sides of the path of travel of the sleeve. It is advantageous to relatively move the seal and cut-off jaws of each pair toward each other so as to clamp the overlapping plys of the sleeve together in a plane disposed medially between opposite sides of the sleeve and to similarly cut-off the sleeve in the same plane. Accordingly, dual actuators are provided with one actuator 168 arranged to move the seal jaws 155 and cut-off jaws 158 to the left as viewed in FIG. 22, and another fluid actuator 169 arranged to move the seal jaws 151 and cut-off jaws 159 to the right as viewed in FIG. 22. The actuator 168 and 169 are preferably of like construction and arranged in opposed relation so that they apply substantially equal and opposite forces when fluid pressure is applied to corresponding ends of the cylinders of the fluid actuators. The bottom seal and cut-off jaws are operated in timed relation with the reciprocation of the mandrel and, as schematically shown in FIG. 33, the valve 170 controls flow of fluid pressure to both actuators 168 and 169 and the valve 170 has an electroresponsive actuator 170*a* energized under the control of a switch 171 operated from a cam 78*b* on the cam shaft 78. As graphically shown in FIG. 34 by the line designated "Bottom seal and cut-off", the bottom seal and cut-off jaws are held open as the mandrel is raised and lowered and are closed when the mandrel reaches its lower position to seal and sever the sleeve at a location below its open upper end.

As previously described, the clutch-brake mechanism 75 is arranged to stop the crank 59 in position in which the mandrel A is in its lower position and the clutch-brake is operative, when energized, to move the mandrel upwardly during the first 180° of rotation of the crank and thereafter move the mandrel downwardly, as shown by the line designated "Mandrel" in FIG. 34. As the mandrel moves upwardly to its raised position, the side seal and holding clamp B is operated to its release position and feed mechanism C is operated to its clamp or feed position, as graphically shown by the lines deaignated "Side Seal Clamp" and "Web Feed" in FIG. 34. As the mandrel moves downwardly, the side seal and holding clamp is moved to its clamp and sealing position while the feed mechanism C is moved to its release position, so that the side seal and holding clamp holds the sleeve in its position during retraction of the mandrel. The sleeve opening device D is extended upwardly relative to the mandrel, preferably at a time prior to the mandrel reaching its fully raised position, and the sleeve opening device is maintained in its extended position until after the mandrel reaches its fully raised position and preferably until the mandrel has started its downward stroke, as is shown by the curve designated "Sleeve Opener" in FIG. 34. The bottom seal and cut-off mechanisms E and F are held open while the mandrel is extended upwardly and then retracted downwardly, and are closed after the mandrel is retracted to a level below the seal and cut-off mechanism to transversely seal the sleeve at a location below its upper end to form a bag in the end of the sleeve, and to sever the bag from the sleeve.

Figure 3:
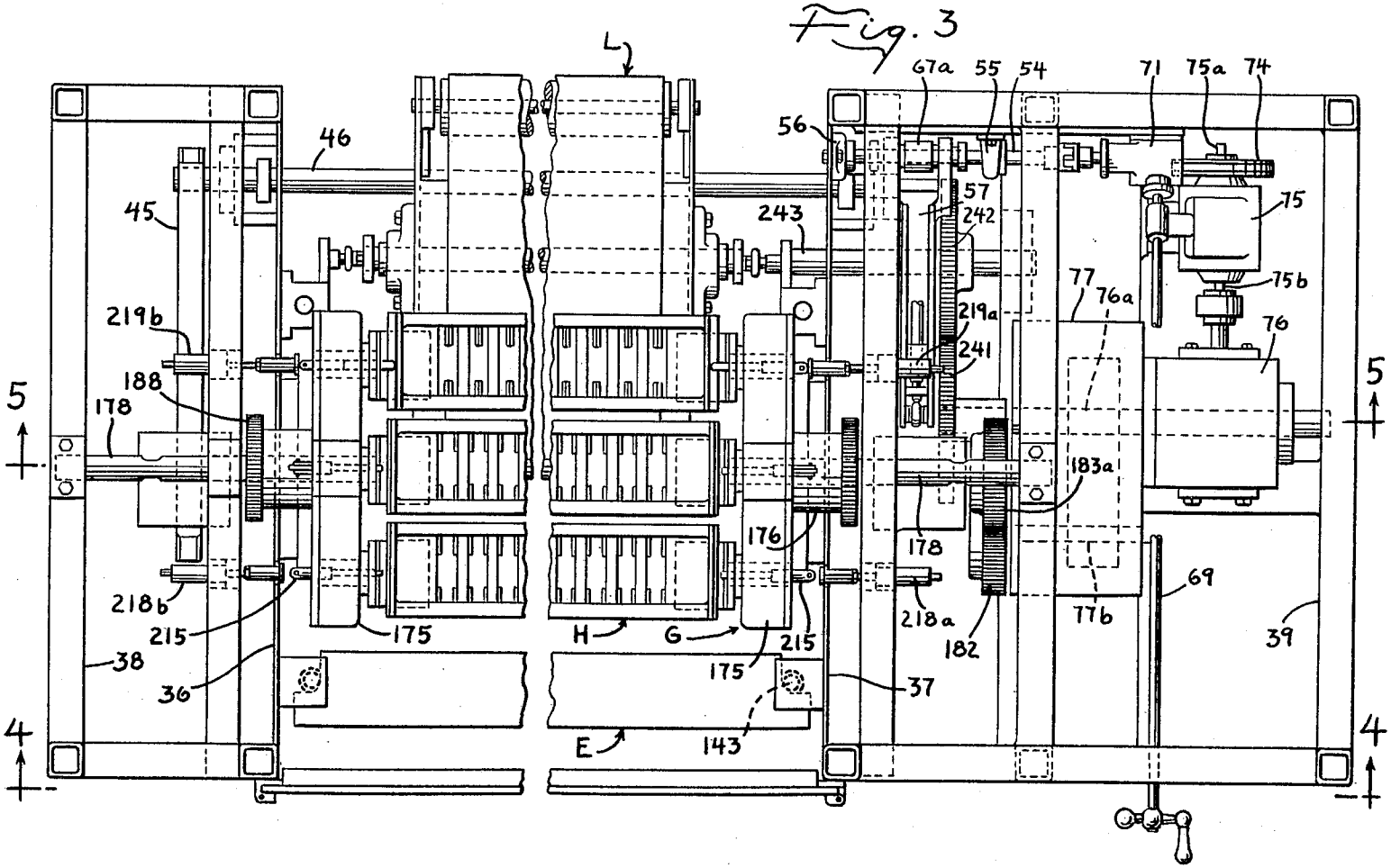
FIG. 3 is a top plan view of the packaging machine with parts of the housing and product dispensing apparatus removed.

The gripper assemblies H on the transfer mechanism G are arranged to grip the open end of the sleeve when the lead end of the sleeve is raised to a preselected position at a bag loading station, and the gripper and transfer mechanism are operative to transfer the bag from the bag loading station to a filling station adjacent the filler J and thereafter transfer the filled bags to a discharge station adjacent the top closing and sealing mechanism K. The transfer mechanism G is advantageously in the form of a turret comprising a pair of end housings 175 each having a hub 176 rotatably supported by bearings 177 on stationary support shafts 178. The turret G has three gripper assemblies H and the turret is indexed through one-third of a revolution in timed relation with the reciprocation of the mandrel. As best shown in FIGS. 3, 4 and 6, the index drive has an index output shaft 77*b* and a drive gear 182 on the index output shaft meshes with a gear 183*a* on one end of a shaft 184. A gear 183*b*, the same as gear 183*a* is provided on the other end of shaft 184 and gears 183*a* and 183*b* each drive a gear 185 on one end of a respective shaft 186 that is drivingly connected through a gear 187 to a gear 188 on the hubs 176. Both ends of the turret are thus driven in unison and the index drive shaft 77*b* of the index drive mechanism is driven through one-third of each revolution of the shaft 76*a*, in the index drive mechanism, so that the turret is indexed through one-third of a rovolution and then stops in the position shown in FIG. 8, each time the mandrel drive crank 59 is rotated through one complete revolution to extend and retract the mandrel.

Figure 15:
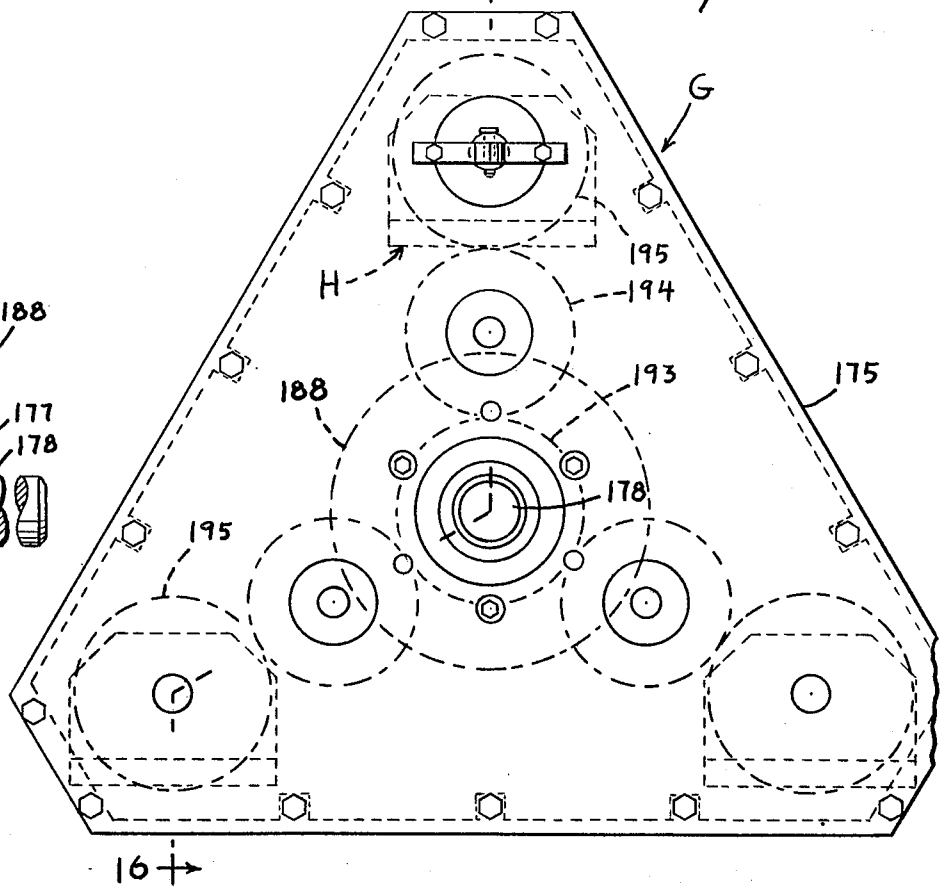
FIG. 15 is an end elevational view of the transfer turret.
Figure 16:
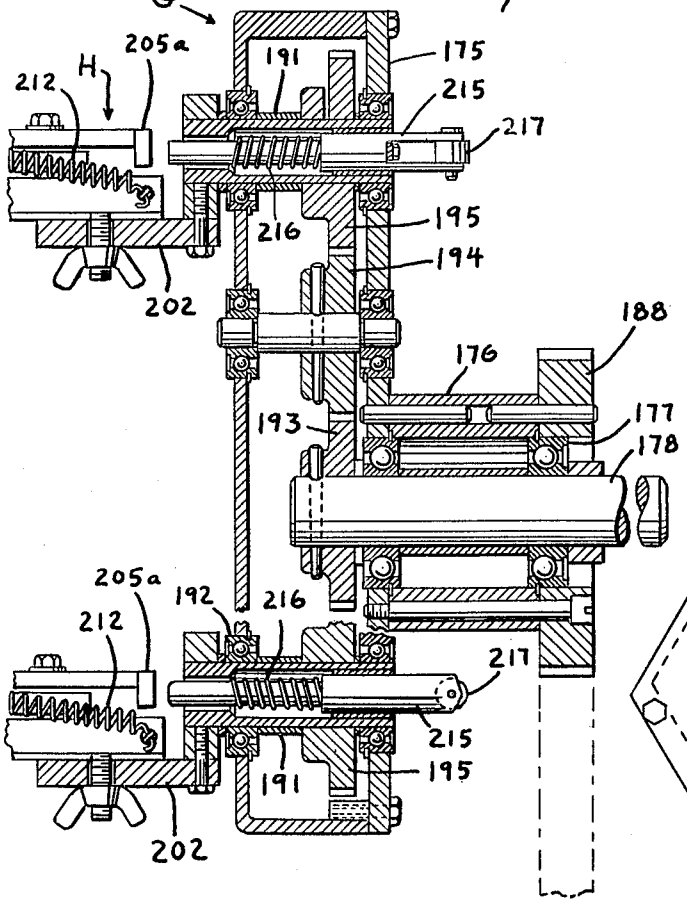
FIG. 16 is a longitudinal sectional view through the turret taken on the plane 16—16 of FIG. 15.

The pouch gripper assemblies H are mounted on the turret in a manner to maintain the pouch gripper assemblies in a predetermined attitude as the turret is indexed. As best shown in FIGS. 15 and 16, the gripper assemblies H have stub shafts 191 at opposite ends that are rotatably supported by bearings 192 on the turret end housings 175, for rotation about the axes paralleling the axis of rotation of the turret and spaced radially outwardly therefrom. A gear 193 is nonrotatably secured to each of the support shafts 178 and held against rotation thereby, and the gear 193 meshes with idler gears 194 that are disposed in meshing engagement with gears 195 fixed to each of the stub shafts 191. The gears 193 and 195 have the same pitch diameter so that, when the turret is indexed through one-third of a revolution, the stub shafts 191 on the gripper assemblies are also rotated relative to the turret housings through one-third of a revolution to maintain the gripper assemblies in a fixed attitude with respect to the horizontal.

Figure 17:
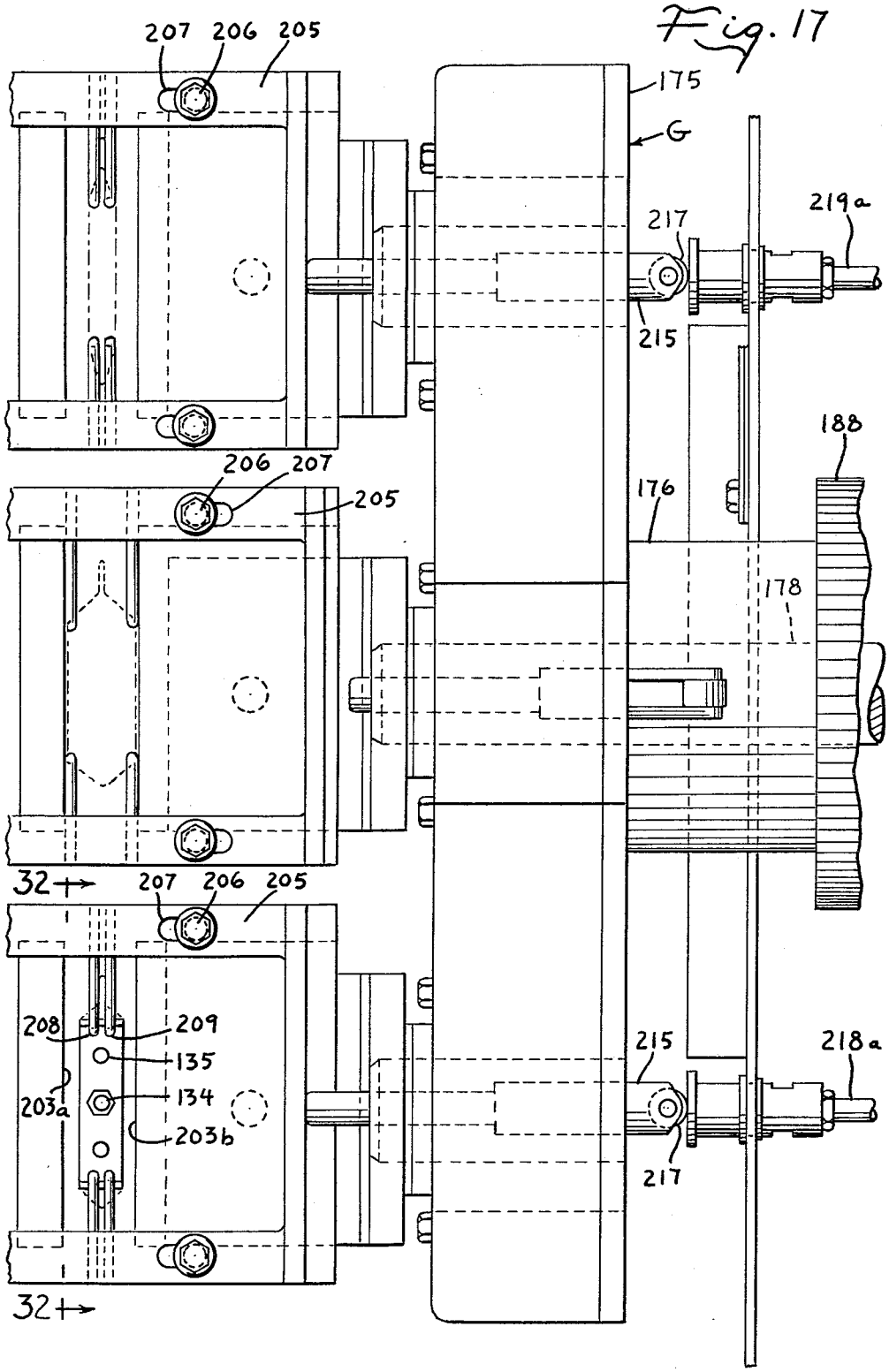
FIG. 17 is a fragmentary horizontal plan view of the turret taken on the plane 17—17 of FIG. 5, and illustrating the parts on a larger scale.
Figure 18:
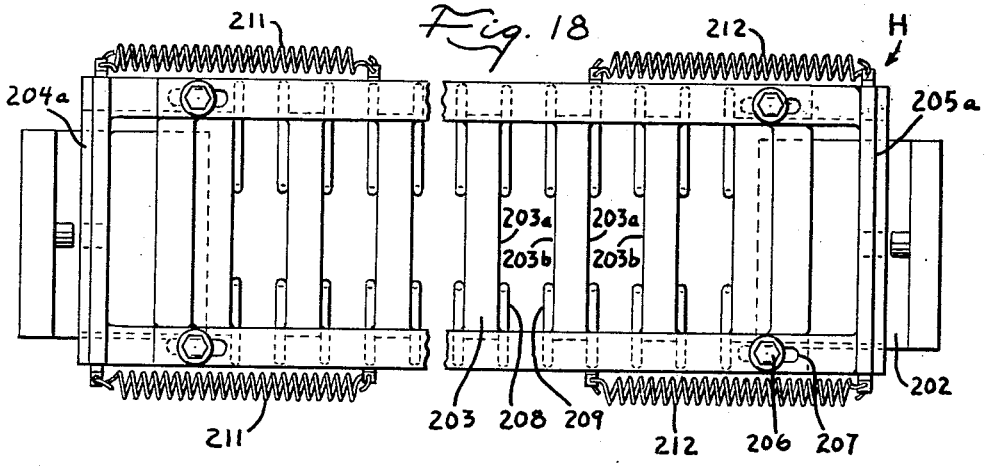
FIG. 18 is a plan view of one of the bag gripper assemblies on the turret.
Figure 19:
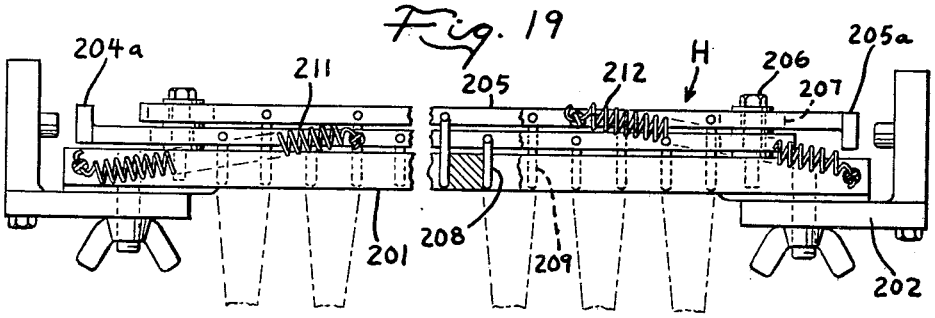
FIG. 19 is a front elevational view of the bag gripper assembly shown in FIG. 18.

The gripper assemblies H include a plurality of pairs of gripper jaws that are operative to grip opposite sides of the open end of the sleeve when the sleeve is advanced to the bag loading station, and to support and hold the bag open as it is transported from the bag loading station to the subsequent filling and closing stations. As best shown in FIGS. 18–21, the bag gripper assemblies H each include a first jaw frame 201 that is supported at its ends by generally L-shaped brackets 202 on the stub shafts 191. The first jaw frame 201 has a plurality of outer jaw members 203 disposed at spaced locations therealong. The jaw members 203 are spaced apart a distance slightly greater than the width of the mandrel and are located in relation to respective ones of the mandrels such that the outer jaw faces 203*a* and 203*b* on opposite sides of adjacent ones of the outer jaw members 203 are disposed along the outer side of the lead end of the sleeve when it is advanced by the mandrel to its forward or bag loading position. The jaw gripping mechanism also includes a second jaw frame 204 and a third jaw frame 205, each of which are mounted as by bolts 206 that extend through slotted openings 207 in the second and third frames, for limiting movement relative to the first jaw frame 201 and relative to each other in a direction lengthwise of the jaw frame 201. The second jaw frame carries a plurality of pairs of inner jaw members 208, with one pair of inner jaw members associated with each lane of the packaging machine, and the third jaw frame 205 carries a corresponding plurality of pairs of inner jaw members 209. The inner jaw members 208 and 209 have a generally L-shaped configuration and extend inwardly from the respective frame and terminate in downwardly extending jaw portions that are adapted to cooperate with the outer jaw faces 203*a* and 203*b* on the first jaw frame to clamp the open end of the bag thereto. The second jaw frame is urged as by tension springs 211 terminally attached to the first jaw frame 201 and to the second jaw frame 204, in a direction to move the inner jaw members 208 toward the outer jaw faces 203*a* on the jaw members 203, and the third jaw frame is yieldably urged as by tension springs 212 terminally attached to the first jaw frame 201 and to the third jaw frame 205, in a direction to urge the inner jaw members 209 toward the outer jaw faces 203*b*. Thus, the inner jaw members 208 and 209 are yieldably urged to their bag gripping position. Provision is made for actuating the gripper jaws at different stations and, as best shown in FIGS. 15–17, a plunger 215 is slidably supported in each of the stub shafts 191 and is yieldably biased as by a spring 216 to a retracted position. The second jaw frame 204 has a member 204*a* at one end arranged to be engaged by the inner end of the plunger 215 on one of the turret housings, and the third jaw frame 205 has a member 205*a* on one end arranged to be engaged by the plunger on the other of the turret housings. Followers 217, conveniently in the form of rollers, are provided on the outer ends of the plungers.

As shown in FIG. 3, a pair of fluid actuators 218*a* and 218*b* are mounted on the intermediate frame sections 37 and 36 respectively at locations to engage the plungers on the gripper assemblies when the gripper assembly is located at the bag loading station. Another pair of fluid actuators 219*a* and 219*b* are mounted on the intermediate frame sections 37 and 36 at locations to engage the plungers of the bag gripper assemblies H when the gripper assemblies are at the top closing and sealing station. As schematically shown in FIG. 33, a control valve 220 is provided to control application of fluid pressure to the fluid actuators 218*a* and 218*b* and the valve 220 has an electroresponsive actuator 220*a* energized under the control of a switch 221 operated in timed relation with the reciprocation of the mandrel and as graphically shown by the line designated "Receiver Gripper Fingers" in FIG. 34, the fluid actuators 218*a*, 218*b* are operated to move the inner bag gripping jaws 208 and 208 toward each other to their release position, before the sleeve is advanced to its fully raised position, and to thereafter release the inner gripper jaws 208 and 209 to allow them to be moved under the bias of the springs 211 and 212 to their bag clamping position shown in FIGS. 18 and 19 when the mandrel reaches its fully raised position. Thus, the inner gripper jaws 208 and 209 are moved to a position closely adjacent each other and preferably less than the width of the blades 131 of the bag opening device D, as shown at the bottom in FIG. 17, to enter the lead end of the sleeve as it is advanced to its raised position. When the fluid actuators 218*a* and 218*b* are thereafter operated to their jaw release position, the jaws 208 and 209 move laterally apart to clamp opposite side walls of the bag to the outer jaw faces 203*a* and 203*b*. As shown by the line designated "Receiver Gripper Fingers" in FIG. 34 the gripper jaws are moved to their clamp position after the mandrel reaches its fully raised position and before the bottom seal and cut-off mechanisms E and F are operated to transversely seal and sever the bag from the sleeve. Thus the gripper jaws are operative to grip the open end of the bag to hold it open and to support the bag after it is severed from the sleeve.

When the transfer mechanism is indexed, the gripper assemblies transport the bags that were loaded at the bag loading station to a filling station below the dispensing apparatus J, while holding the bags open with their open end facing upwardly. The packaging apparatus can be adapted to package various different products including articles and fluent materials such as powder, liquids and semi-liquid material. The product dispensing apparatus J can be of any type which is operable to dispense the desired quantity of products into the bags and which can either be operated under the control of a signal from the packaging machine to enable operation of the dispenser in timed relation with the cycling of the packaging machine, or which can be adapted to generate a control signal for controling cycling of the packaging machine in timed relation to the dispenser apparatus. In the dispenser apparatus shown in FIGS. 20 and 21, the dispenser has a product dispensing control 222 operated by an actuator 223, as schematically shown in FIG. 33, the dispenser actuator 223 is of the fluid operated type and fluid under pressure is reversibly supplied to the actuator 223 by a valve 224 having an electroresponsive valve actuator 224*a* energized in timed relation with the packaging machine by a switch 227 operated by a cam 78*d* on the cam shaft 78.

Figure 20:
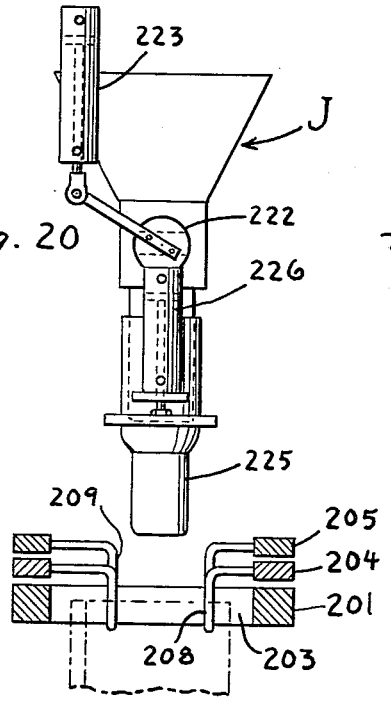
FIGS. 20 and 21 are fragmentary views illustrating the product dispenser and nozzle in different moved positions.
Figure 21:
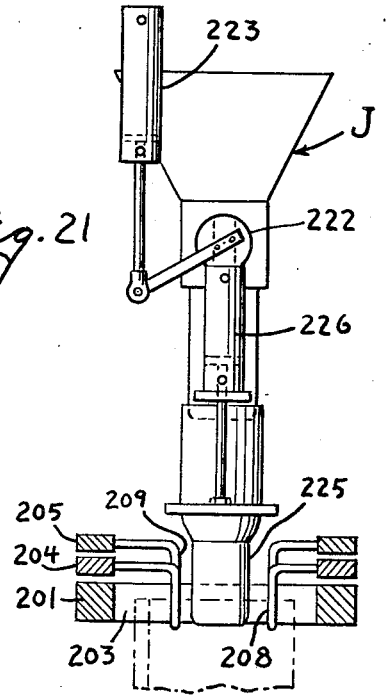

There are some materials for example some powdered materials which could adversely affect heat sealing of the top of a bag if they contacted the inner walls of the bag in the area to be heat sealed. Accordingly, the dispenser is advanageously provided with vertically movable spouts such as shown at 225 in FIGS. 20 and 21, and which spouts are movable from a raised position as shown in FIG. 20 above the path of travel of the bag gripper assemblies H to a lowered position as shown in FIG. 21 in which the spout extends into the open upper end of the bags at the filling station. A means such as fluid actuators 226 is provided for moving the spout between its raised and lowered positions and as schematically shown in FIG. 33, a valve 229 controls application of fluid pressure to fluid actuators 226. The valve 229 has an electroresponsive actuator 229*a* energized under the control of a switch 230 operated by a cam 78*c* on the cam shaft 78, to effect operation of the actuators 226 in timed relation with the indexing of the turret and the operation of the filler mechanism. As graphically shown in FIG. 34 by a line designated "FIll Product" and "Filler Spout", the filler spouts are raised and filling is prevented during indexing of the turret. The filler spout is lowered and the filling enabled after the turret is indexed. As shown by the line designated "Turret" in FIG. 34, indexing of the turret is effected during a relatively small portion of the overall cycle time of the packaging machine and this allows a major portion of the overall packaging machine cycle time for filling the bags at the filling station.

The transfer mechanism G maintains the bags with their open tops facing upwardly as it transfers the bags from the filling station to a top closing and sealing station. In order to provide clearance for the gripper assemblies on the transfer mechanism and for the bags, the top closing and sealing mechanism K is mounted for movement into and out of a position for engaging the bags adjacent their upper ends. In the preferred embodiment illustrated, a bag sealing and closing mechanism is mounted for movement along a vertical path into and out of a bag receiving position and, as best shown in FIGS. 5, 8 and 27–31, the bag closing and sealing mechanism K includes a rigid frame having spaced end members 231 and guide bars 232 and 233 that extend between the end members. The frame is secured as by brackets 234 that are fixed on rods 235 and the rods are supported for vertical sliding movement in guide bushings 236 and 237 on the intermediate frame sections 37 and 36 (FIGS. 5 and 8). The top closing and sealing mechanism K is raised and lowered in timed relation with movement of the mandrel and turret and, as shown in the curve designated "Top Sealer" in FIG. 34, the top closing and sealing mechanism is conveniently raised and lowered as the mandrel is raised and lowered, with the sealer reaching its fully raised position substantially after indexing of the turret has been completed. As best shown in FIGS. 3, 5 and 8, a gear 241 on the output shaft 76*a* in the index drive mechanism 77 meshes with a gear 242 on the crank shaft 243 to rotate the crank shaft through one revolution each time the output shaft 76*a* is driven through one revolution. The crank shaft has two cranks designated 244*a* and 244*b* in FIG. 5 that are connected through links 245 to the end members 231 to raise and lower the end members as the cranks are rotated.

As best shown in FIGS. 27–31, the top closing and seal jaw mechanism K includes a first jaw frame having spaced frame members 246 and 247 that are slidably supported as by bushings 248 and 249 on the guide bars 232 and 233. A first set of sealing jaws 251, one for each of the lanes of the multi-lane wrapping machine, are secured to and between the frame members 246 and 247. A second jaw frame including frame members 252 and 253 is also mounted as by bushings 254 and 255 on the guide rods 233 and 232 for movement therealong and a second set of sealing jaws 256, one for each lane of the multi-lane wrapping machine, are mounted on the frame members 252, 253 and extend therebetween. The sealing jaws 251 and 256 are arranged in opposed pairs at relatively opposite sides of the bags as they are supported by the turret at the top sealing and closing station, and the frames are movable relative to each other to bring opposed pairs of the jaws 251 and 256 together to clamp and seal opposite sides of the bag together. One of the jaws 256 of each pair is heated to effect heat sealing of the overlapping plys, as shown, elongated heated rods 258 are mounted in the frame member 252 and 253 to heat the same and thereby heat the jaws 256 to a temperature sufficient to effect heat sealing.

Figure 27:
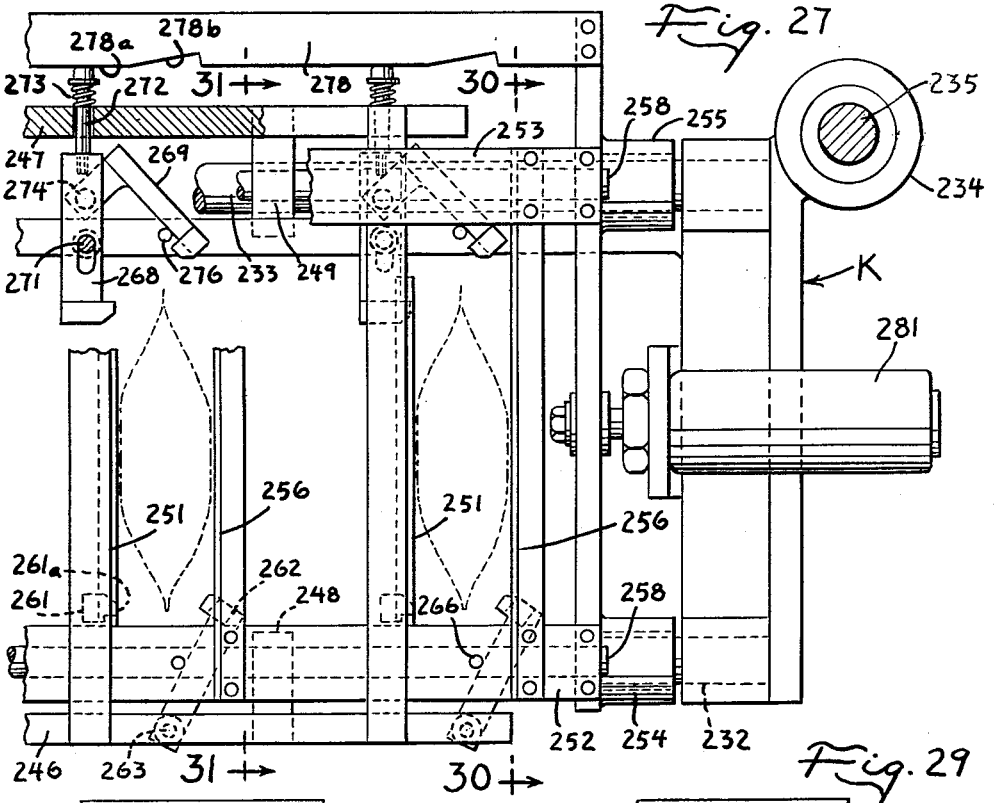
FIGS. 27-29 are fragmentary horizontal sectional views taken on the plane 27—27 of FIG. 8 and illustrating the bag closing and sealing mechanism in different moved positions and on a larger scale than FIG. 8.
Figure 28:
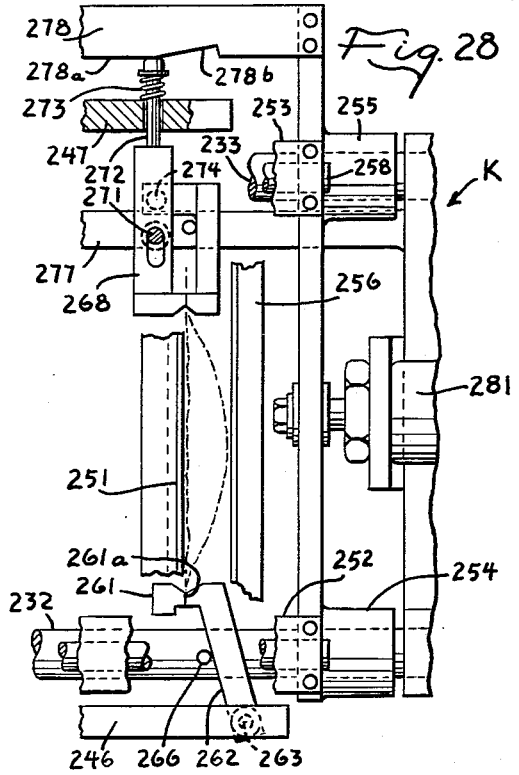
Figure 29:
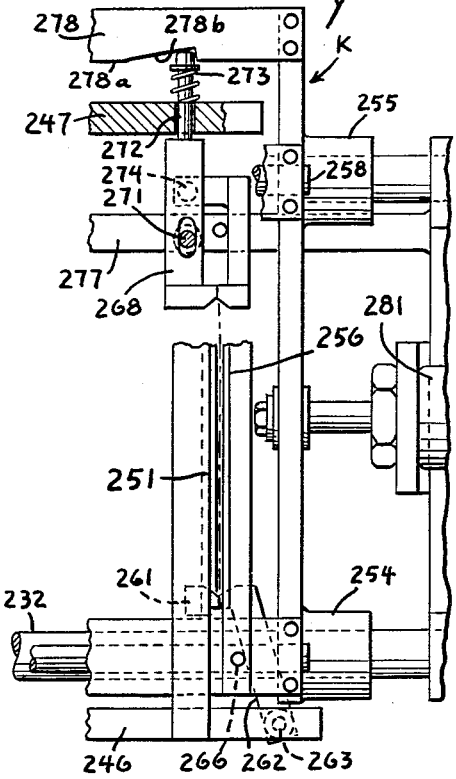
Figure 30:
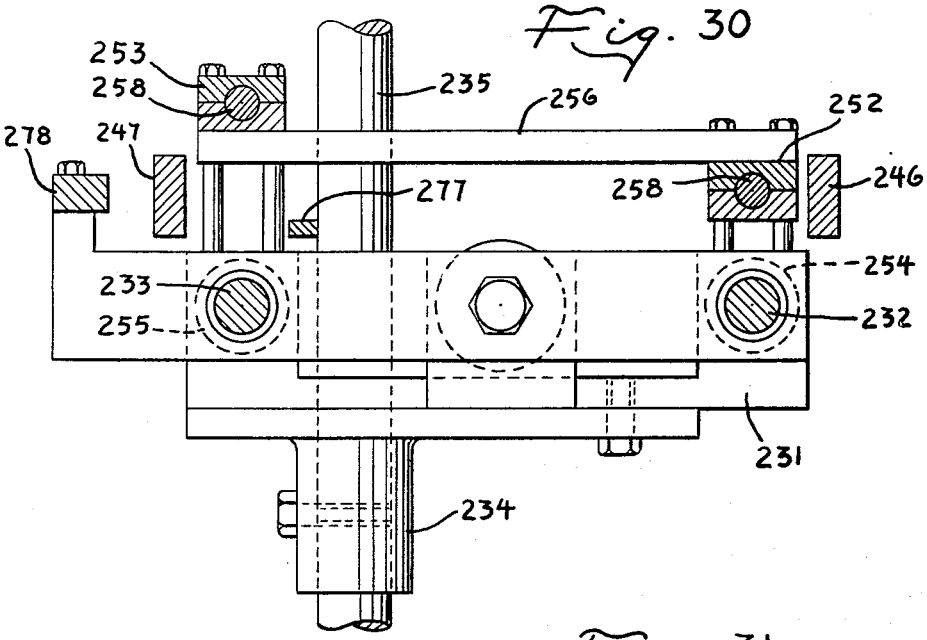
FIG. 30 is a transverse sectional view through the top closing and sealing mechanism taken on the plane 30—30 of FIG. 27.
Figure 31:
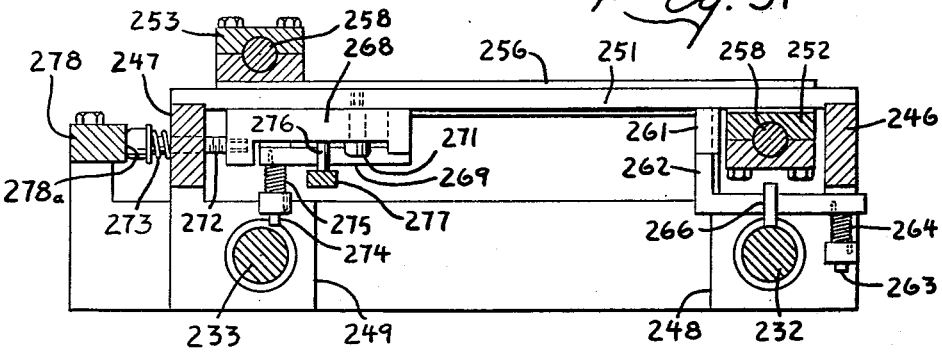
FIG. 31 is a transverse sectional view through the top closing and sealing mechanism taken on the plane 31—31 of FIG. 27.

Side gripper jaws are provided for clamping the upright edge portions of the bags at the closing and sealing station to support the bags when they are released from the transfer mechanism and to also draw the bags to a closed position. A plurality of pairs of gripper jaws 261, 262, one pair for each lane of the machine, are provided for gripping one side edge of the bags. The side gripper jaws 261 are each mounted on the underside of a respective one of the sealing jaws 251 and each has its jaw face 261*a* disposed in substantially the same vertical plane as the jaw face on the sealing jaw 251. The side gripper jaws 262 are swingably mounted by a pin 263 on one of the frame members 246 for swinging movement toward and away from a respective one of the side gripper jaws 261. The side gripper jaws 262 are yieldably biased by torsion springs 264 (FIG. 31) to their closed position and jaw actuating pins 266 are provided at spaced locations along one of the guide bars 232 and engage the side gripper jaws 262 intermediate their ends to hold and side gripper jaws 262 in their open position when the frame members 246 and 247 are in the position shown in FIG. 27. The side gripper jaws 262 move under the bias of springs 264 toward the side gripper jaws 261, as the frame member 246 is moved to the right to a position shown in FIG. 28. The pairs of side gripper jaws 261 and 262 are arranged to grip one side edge of a respective one of the bags, and a plurality of pairs of side gripper jaws 268 and 269, one pair for each lane of the packaging machine, are provided for gripping the other side edge of the bag. The side gripper jaws 268 are each mounted for limited movement relative to a respective one of the sealing jaws 25 in a direction generally paralleling the length of the sealing jaws and, as shown in FIGS. 27–29 and 31, are supported on the underside of a respective one of the sealing jaws 251 by a headed pin 271 that extends through an elongated slot in the side gripper jaw 268. A guide pin 272 on each side gripper jaw 268 extends through an opening in the frame member 247 and a compression spring 273 is interposed between the frame member and a head on the pin 272 to yieldably urge respective side gripper jaw 268 in a direction away form the associated side gripper jaw 261. Each side gripper jaw 269 is swingably supported as by a pivot pin 274 on the respective side gripper jaw 268 for movement therewith and for swinging movement relative thereto between an open position as shown in FIG. 27 and a closed position as shown in FIGS. 28 and 29. Jaws 269 are also yieldable urged to their closed position by torsion springs 275, and operating pins 276 are provided at spaced locations along a fixed frame member 277 and arranged to engage the jaws 269 intermediate their ends to hold the jaws 269 in their open positions when the frame members 246 and 247 positioned as shown in FIG. 27. The side gripper jaws 289 move under the bias of springs 275 to their closed position when the frame members 246 and 247 are moved to the right to the position shown in FIG. 28. An elongated cam member 278 is attached to the frame members 252 and 253 for movement therewith and has a cam face that overlies the ends of the pins 272 to control movement of the side gripper jaws 268 and 269 in a direction toward and away from the corresponding side gripper jaws 261 and 262. As will be seen from FIGS. 27–29, the cam member 278 has a cam surface 278*a* which normally engages the pins 272 to hold the jaws 268 and 269 in an inner position, and a second cam surface 278*b* which allows the jaws 268 and 269 to move outwardly under the bias of the springs 273. One fluid actuator 282 (See FIGS. 5 and 33) is provided for moving the frame members 246, 247 to the right as viewed in FIGS. 27–29 and a second fluid actuator 281 (FIGS. 5, 27 and 33) is provided for moving the frame members 252 and 253 to the left as viewed in FIGS. 27–29. Valves 283 and 284 respectively control the application of fluid pressure to the actuators 281 and 282 and have an electroresponsive actuators 283*a* and 284*a* energized under the control of switches 285 and 286 operated by cam 80*d* and 80*e* on the cam shaft 80. The fluid actuators 281 and 282 are operated in timed relation with each other and with the vertical movement of a top closing and sealing mechanism K, as shown by the lines designated "Top Sealer Clamp" and "Top Seal Bar" in FIG. 34, so that the top sealer clamp mechanism and the top seal bars are open as the mechanism K is elevated. The fluid actuator 282 is operated after the mechanism K is moved to its raised position and before operation of the actuator 281 so that the side gripper jaws 261, 262 and 268, 269 are first moved to their closed position to clamp opposite side edges of the bag, as shown in FIG. 28. Actuator 281 is thereafter operated and the cam surface 278*b* is arranged so that the side gripper jaws 268, 169 can shift outwardly before the seal jaw 256 closes against the bag, to thereby draw the top of the bag to a closed position just prior to closing of the jaws 251 and 256 and heat sealing of the top of the bag.

As schematically shown in FIG. 33, a valve 288 controls the application of fluid pressure to the fluid actuators 219*a* and 219*b* and has an electroresponsive actuator 288*a* energized under the control of a switch 289 operated by a cam 80*c* on the cam shaft 80. The cam 80*c* controls the actuators 219*a* and 219*b* for operating the gripper assemblies at the top sealing and closing station to move the turret gripper jaws 208 and 209 to their release position after the side gripper jaws on the top closing and sealing machanism K are moved to their clamp position, and before the sealing jaws 251 and 256 are moved to their sealing position, as graphically shown by the line designated "Discharge Gripper Fingers" in FIG. 34. After the top of the bag is sealed, the actuators 281 and 282 for the top seal mechanism K are moved to their open or release position and the sealed packages are then allowed to drop onto the discharge conveyor L. In the embodiments illustrated, the discharge conveyor L is of the endless type with the upper run disposed below the top closing and sealing mechanism K to receive the bags when they are discharged. Any suitable means may be provided for driving the discharge conveyor L and it may, for example, be driven continuously or in intermittent fashion in timed relation with the operation of the packaging machine as graphically shown by the line designated "Discharge Conveyor" in FIG. 34. Intermittent drive for the outlet conveyor can be effected by a power take-off connected to shaft 243 to advance the conveyor a preselected distance each time the packaging machine is cycled.

From the foregoing is is believed that the construction and operation of the packaging machine will be readily understood. An end portion of a strip of web material is formed into a sleeve around a mandrel and the sleeve is advanced with the mandrel during at least a portion of the forward stroke of the mandrel so that the mandrel supports and guides the sleeve during feeding of the sleeve. A portion on the end of the mandrel is moved through the end of the sleeve to provide a positive opening of the lead end of the sleeve, and the mandrel is then retracted into the sleeve transversely sealed and severed at a location inwardly of its open end to form an open ended bag.

A gripper assembly on the turret is operated at the bag loading station in timed relation with the reciprocation of the mandrel to grip the open end of the bag when it is advanced to a forward or bag loading position, and the turret then operates to transfer the bags with their open end up sequentially to a bag loading station and to a top closing and sealing station. This enables filling of one bag and closing of a previously filled bag while another bag is being formed and advanced with the mandrel to the bag loading station.

The length of the bags can be readily adjusted by adjusting the stroke of the mandrel, and further, the lengths of the bags can be automatically correlated with the printed indicia on the strip material to effect registration of the printed indicia with the bag. The apparatus for forming the webs into sleeves, feeding the sleeves, and transversely sealing and severing the sleeve is particularly adapted for use in a multi-lane machine for increased production since it enables the lanes to be spaced close together and thereby minimize the overall size of the multi-lane machine.

The embodiments of the invention in which an exclusive property or privilege is claimed are defined as follows:

1. A packaging machine for making bag type packages from strip web material comprising, product dispensing means for dispensing product at a bag filling station, an elongated mandrel having a forward end portion, means for moving the mandrel lengthwise along a feed path in forward and return strokes, means for forming an end portion of strip web material around the mandrel into a sleeve having a lead end, feed means for advancing the sleeve with its lead end forward along said feed path during at least a portion of the forward stroke of the mandrel to a forward position, means for opening the lead end of the sleeve, a plurality of bag gripper assemblies and transfer means for moving the bag gripper assemblies from a bag loading station in overlying relation to the leading end of the sleeve at its forward position to the bag filling station, each bag gripper assembly including first and second outer jaws laterally spaced apart and first and second inner jaws disposed between the outer jaws and movable relative thereto, means for operating the bag gripper assembly at the bag loading station to move the inner jaws inwardly relative to the outer jaws to a release position for reception in the open end of the sleeve when it is advanced to its forward position and for moving the inner jaws outwardly to a clamp position after the sleeve is advanced to its forward position to grip opposite side walls of the open lead end of the sleeve and to support the lead end of the sleeve in an open condition, means for severing the sleeve at a location spaced inwardly of its lead end to form a bag supported by the bag gripper assembly transverse seal means for transversely sealing the sleeve at a location spaced from the end supported by the gripper assembly means for maintaining the jaws of the bag gripper assemblies in a clamp position to support the bags as the transfer means moves the gripper assemblies from the bag loading station to the bag filling station, the transfer means including means for positioning the bag gripper assembly at bag filling station in an attitude supporting the bag carried thereby with its open end facing upwardly to receive product dispensed by the product dispensing means at the filling station, and means for operating the product dispensing means to dispense product into bags at the bag filling station.

2. A packaging machine according to claim 1 wherein the feed path extends upwardly and the lead end of the sleeve is its upper end.

3. A packaging machine according to claim 1 wherein the means for opening the lead end of the sleeve includes means operative to extend said forward end portion of said mandrel to the lead end of the sleeve to open the same and to thereafter retract the forward end portion of the mandrel into the sleeve a distance greater than the desired bag length prior to transverse sealing of the sleeve.

4. A packaging machine according to claim 1 wherein the forward end portion of the mandrel includes a sleeve opening device mounted for extension and retraction relative to the mandrel in a direction parallel to said feed path, and said means for opening the lead end of the sleeve includes means operated in timed relation with the feed means to extend the sleeve opening device relative to the mandrel and to the lead end of the sleeve to open the lead end of the sleeve and for thereafter retracting the sleeve opening device relative to the mandrel, the sleeve opening device having blade portions that extend alongside the inner jaws on the bag gripper assembly at the bag loading station when the leading end of the sleeve is in its forward position.

5. A packaging machine according to claim 4 wherein said feed means includes feed jaw means mounted for reciprocation along a path paralleling the feed path drive means for moving said feed jaw means in forward and return strokes, and feed jaw actuating means moving said feed jaw means into feeding engagement with the sleeve during at least a portion of the forward stroke of said feed jaw means to advance the sleeve.

6. A packaging machine according to claim 5 wherein the means forming the strip web material into a sleeve includes clamp jaw means mounted at a fixed location along said feed path, actuating means for moving said clamp jaw means into gripping engagement with lengthwise extending edge portions of the strip web material when the feed jaw means is moved out of gripping engagement with the sleeve.

7. A packaging machine according to claim 6 wherein the strip web material has indicia at spaced locations therealong corresponding to the desired bag length, sensing means for sensing the spaced indicia on the strip web material, and means responsive to said sensing means for controlling said feed jaw actuating means and operative to vary the portion of the forward stroke of the feed jaw means during which the feed jaw means is in feeding engagement with the sleeve.

8. A packaging machine according to claim 4 wherein said feed means is mounted for movement with the mandrel during at least a portion of the forward stroke of the mandrel, and said feed jaw actuating means clamps the sleeve to the mandrel during at least a portion of the forward stroke of the mandrel.

9. A packaging machine according to claim 1 wherein the transfer means is arranged to move the bag gripper assemblies from the bag filling station to a third station and to maintain the gripper assemblies in an attitude supporting the bag carried thereby with the open end facing upwardly, and gripper release means at the third station for operating the bag gripper assembly thereat to move the inner gripper jaws to a release position for discharging filled bags at the third station.

10. A packaging machine according to claim 9 including means at the third station for closing the bags.

11. A packaging machine according to claim 1 wherein the transfer means is arranged to move the bag gripper assemblies from the bag filling station to a third station and to maintain the gripper assemblies in an attitude supporting the bag carried thereby with the open end facing upwardly, first and second outer gripper jaw means at the third station operable between an open position and a closed position gripping the bag at first and second spaced locations adjacent its upper end, top sealing jaw means at the third station for closing and sealing the open end of the bag, and means for operating the outer and inner jaws of the bag gripper assembly at the third station and the first and second outer gripper jaw means and the top sealing jaw means in timed relation.

12. A packaging machine according to claim 11 including means for relatively shifting the first and second outer gripper jaw means away from each other after they have been moved to a closed position and before operating the top sealing jaw means.

13. A packaging machine according to claim 9 wherein the transfer means moves the gripper assemblies in a closed loop course past said bag loading station, bag filling station and said third station.

14. A packaging machine according to claim 1 including means for supporting a supply roll of the strip web material, means for longitudinally folding the strip of web material from the supply roll to bring opposed sides into face-to-face contact, means for guiding the longitudinally folded strip into alignment with the mandrel and such that opposite sides of the longitudinally folded strip extend along opposite sides of the mandrel, said means for moving the mandrel including an arm extending laterally of the mandrel and between the edges of the longitudinally folded strip.

15. A packaging machine according to claim 1 in which a plurality of said mandrels are provided and mounted in parallel relation for movement in unison, each bag gripper assembly including a plurality of sets of said inner and outer jaws corresponding to the number of mandrels.

16. A packaging machine according to claim 15 including means for supporting a plurality of supply rolls of web material corresponding to the number of mandrels, means for longitudinally folding each strip of web material from the supply rolls to bring opposed sides into face-to-face contact, means for guiding the longitudinally folded strips into alignment with a respective one of the mandrels and such that opposite sides of each strip extend along opposite sides of the associated mandrel, the means for moving the mandrel including arms extending laterally of each mandrel and between the edges of the longitudinally folded strip, and a reciprocable head connected to each of the arms for reciprocating the mandrels in unison.

17. A packaging machine according to claim 1 in which a plurality of said mandrels are provided and mounted in parallel relation for movement in unison, each of said bag gripper assemblies including an elongated outer jaw frame having transverse members at spaced locations therealong defining a number of said first and second outer jaws corresponding to the number of mandrels and arranged along relatively opposite sides of the feed path of a respective one of the mandrels when gripper assembly is at the bag loading station, elongated first and second inner jaw frames mounted on the outer jaw frame for lengthwise movement relative thereto and relative to each other, the first inner jaw frame having a number of said first inner jaws mounted thereon corresponding to the number of mandrels and located between respective ones of the first and second outer jaws, the second inner jaw frame having a number of the second inner jaws mounted thereon corresponding to the number of mandrels and located between respective ones of the first and second outer jaws.

18. A packaging machine according to claim 17 including means yieldably biasing the first and second inner jaw frames in relatively opposite directions to normally move the first and second inner jaws to a clamp position.

19. A packaging machine according to claim 1 wherein the transfer means is operative to move the gripper assemblies from the bag filling station to a bag closing station, and means at the bag closing station for closing and sealing the open end of the bag.

20. A packaging machine according to claim 1 wherein the transfer means is arranged to move the gripper assemblies from the bag filling station to a bag closing station, means at the bag closing station of engaging and supporting a bag, means for moving the gripper jaw means of the gripper jaw assembly at the bag closing station to its release condition, and sealing jaw means at the bag closing station for closing and sealing the open end of the bag.

21. A packaging machine according to claim 20 wherein the means for supporting and engaging the bag at the bag closing station includes first and second pairs of side gripper jaws operable between on open position and a closed position clamping lengthwise edge portions of the bag at a location below its upper end.

22. A packaging machine according to claim 21 including means operative while the first and second pairs of side gripper jaws are in a closed position clamping lengthwise edge portions of the bag and for relatively moving the first and second pairs of side gripper jaws in a direction to increase the spacing between the first and second pairs of side gripper jaws.

23. A packaging machine for making bag-type packages from strip web material comprising, means for forming an end portion of strip web meterial into a tubular sleeve portion having a lead end, means for advancing the tubular sleeve portion upwardly with said lead end leading forward along an upwardly extending path paralleling the axis of the tubular sleeve portion to a raised position, means for opening the upper lead end of the tubular sleeve portion, a plurality of gripper assemblies and transfer means for moving the gripper assemblies from a first station overlying the upper lead end of the tubular sleeve portion at said upper position thereof to at least a second station, each gripper assembly including first and second outer gripper jaw means laterally spaced apart and first and second inner gripper jaw means disposed between the outer gripper jaw means, means mounting the inner and outer gripper jaw means for relative movement between a release condition in which the first and second inner gripper jaw means are spaced inwardly from the respective first and second outer gripper jaw means and clamp condition alongside the respective first and second outer gripper jaw means, transverse seal means for transversely sealing the sleeve portion at a location below its upper lead end to form a bag that is open at the end of the sleeve portion, means for severing the sleeve portion below the transverse seal to separate a bag from the sleeve portion, means for operating said gripper assemblies to move the inner gripper jaw means of gripper assembly at such first station from their release condition to their clamp condition to grip the end of the tubular sleeve and for maintaining the inner gripper jaw means in the clamp condition as the transfer means moves the gripper assembly from the first station to the second station to transport the separated bag to the second station, and means at the second station for depositing product in the bag through the oopen end thereof.

24. A packaging machine according to claim 23 wherein said transfer means comprises a turret mounted for rotation about a generally horizontal turret axis; means mounting said gripper assemblies on the turret for rotation relative thereto about generally horizontal axes angularly spaced about said turret axis, means for indexing the turret to move one gripper assembly from the first station to the second station, and means on the turret for maintaining the gripper assemblies in a predetermined attitude supporting the bags with the open end of the bags facing upwardly as the turret is indexed.

25. A packaging machine according to claim 23 wherein said transfer means comprises a turret mounted for rotation about a generally horizontal turret axis, means mounting three of said gripper assemblies on the turret for rotation relative thereto about generally horizontal axes equi-angularly spaced apart about said turret axis, means for indexing the turret to move one gripper assembly from said first station to the second station while moving a second gripper assembly from said second to a third station and while moving a third gripper assembly from said third station to said first station, means on the turret for maintaining the gripper assemblies in a predetermined attitude as the turret is indexed, and gripper release means at said third station for operating the gripper assembly thereat to move said inner and outer gripper jaw means to a release condition.

26. A packaging machine according to claim 25 including means at the third station for closing the bag.

27. A packaging machine according to claim 25 including first and second side gripper jaw means at the third station operable between an open position and a closed position clamping upright edge portion of the bag at a location below its lower end, sealing jaw means at the third station for closing and sealing the open end of the bag, and means for operation the gripper release means and the first and second side gripper jaw means and the sealing jaw means in timed relation.

28. A packaging machine according to claim 25 including a mandrel disposed in the sleeve and having an upper end portion, and means for extending the upper end portion of the mandrel to the lead end of the sleeve to open the same while the gripper assembly at said first station is moved to its clamp condition, and means for retracting the forward end portion of the mandrel into the sleeve prior to transverse sealing of the sleeve.

29. A method of making bag-type packages from strip web material comprising, forming an end portion of strip web material around an elongated mandrel into a sleeve having a lead end, moving the mandrel lengthwise along a feed path in forward and return strokes, advancing the sleeve along said feed path with its lead end forward during at least a portion of the forward stroke of the mandrel to a forward position, opening the lead end of the sleeve, positioning a gripper assembly at a bag loading station overlying the lead end of the sleeve at the forward position thereof, the gripper assembly including first and second outer gripper jaw means laterally spaced apart and first and second inner gripper jaw means disposed between the outer gripper jaw means, the inner and outer gripper jaw means being relatively movable between a release condition in which the first and second inner gripper jaw means are spaced inwardly from the respective outer gripper jaw means and a clamp condition in which the first and second inner gripper jaw means are disposed alongside the respective first and second outer gripper jaw means, relatively moving the inner and outer gripper jaws from their release condition to their clamp condition after the sleeve is advanced to said forward position, to grip opposite side walls of the open lead end of the sleeve and to support the lead end of the sleeve in an open condition, transversely sealing the sleeve at a location spaced inwardly of its lead end to form a bag in the sleeve that is open at the lead end, severing the sleeve at a location inwardly of the transverse seal to separate the bag from the sleeve and provide an unsealed lead end on the remaining portion of the sleeve, moving the gripper assembly from the loading station to a bag filling station and positioning the gripper assembly at the bag filling station in an attitude to support the bag carried thereby with its open end facing upwardly to receive product, and dispensing product into the bag at the filling station.

30. A method of making bag-type packages according to claim 29 wherein the feed path extends upwardly and the lead end of the sleeve is its upper end.

31. A method of making bag-type packages according to claim 29 wherein opening of the lead end of the sleeve is effected by extending a forward end portion of the mandrel forwardly to the lead end of the sleeve to open the same and thereafter retracting the forward end portion of the mandrel into the sleeve a distance greater than the desired bag length prior to transverse sealing of the sleeve.

* * * * *

UNITED STATES PATENT AND TRADEMARK OFFICE

CERTIFICATE OF CORRECTION

PATENT NO. : 4,448,010

DATED : May 15, 1984

INVENTOR(S) : Roger H. Stohlquist et al

It is certified that error appears in the above-identified patent and that said Letters Patent are hereby corrected as shown below:

Column 19, line 7, after "path" (second occurrence) insert a -- , --;

Line 33, "jaw actuating" should be deleted.

Column 20, line 67, "of" should be -- for --.

Column 22, line 55, "jaws" should be -- jaw --;

-- means -- should be inserted after "jaw".

Signed and Sealed this

*Sixteenth* Day of *October 1984*

[SEAL]

*Attest:*

GERALD J. MOSSINGHOFF

*Attesting Officer*

*Commissioner of Patents and Trademarks*